US006382768B1

(12) United States Patent
Koitabashi et al.

(10) Patent No.: US 6,382,768 B1
(45) Date of Patent: May 7, 2002

(54) METHOD OF DRIVING A PLURALITY OF HEATING ELEMENTS AT SHIFTED TIMINGS

(75) Inventors: Noribumi Koitabashi, Yokohama; Osamu Iwasaki, Tokyo; Ryoji Inoue, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/884,462

(22) Filed: Jun. 27, 1997

(30) Foreign Application Priority Data

Jun. 28, 1996 (JP) ..... 8-170159
May 21, 1997 (JP) ..... 9-131388

(51) Int. Cl.[7] ..... B41J 2/16; B41J 2/05
(52) U.S. Cl. ..... 347/48; 347/57
(58) Field of Search ..... 347/48, 57, 56, 347/62, 15, 60

(56) References Cited

U.S. PATENT DOCUMENTS

| | | | | |
|---|---|---|---|---|
| 4,251,824 A | | 2/1981 | Hara et al. | 347/57 |
| 4,646,110 A | * | 2/1987 | Ikeda | 347/48 X |
| 4,965,594 A | * | 10/1990 | Komuro | 347/48 X |
| 5,479,196 A | | 12/1995 | Inda | 347/92 |
| 5,731,828 A | * | 3/1998 | Ishinaga | 347/48 X |
| 5,886,716 A | * | 3/1999 | Heinzl | 347/48 |

FOREIGN PATENT DOCUMENTS

| | | | | |
|---|---|---|---|---|
| EP | 719647 A2 | | 12/1995 | B41J/2/21 |
| EP | 694392 A2 | | 1/1996 | B41J/2/05 |
| EP | 707694 A2 | | 4/1996 | B41J/2/05 |
| JP | 55132259 | | 10/1980 | B41J/3/04 |
| JP | 62240558 | | 10/1987 | B41J/3/04 |
| JP | 62261452 | | 11/1987 | B41J/3/04 |
| JP | 62-261453 | * | 11/1987 | B41J/3/04 |
| JP | 1-257059 | * | 10/1989 | B41J/3/04 |
| JP | 06216957 | | 8/1994 | H04L/27/22 |

* cited by examiner

*Primary Examiner*—Judy Nguyen
(74) *Attorney, Agent, or Firm*—Fitzpatrick, Cella, Harper & Scinto

(57) ABSTRACT

An ink-jet recording method for recording on a recording medium, includes the steps of preparing an ink-jet recording head which has a plurality of electro-thermal conversion elements that can be independently driven in an ink channel communicating with an ejection orifice, and ejects ink from the ejection orifice by bubbling the ink upon driving the electro-thermal conversion elements and ejecting the ink from the ejection orifice by relatively shifting the bubbling timings defined upon driving of at least two electro-thermal conversion elements within the range in which the ejection characteristics of the ink do not deteriorate as compared to those obtained when the ink is bubbled by simultaneously driving the at least two electro-thermal conversion elements, when the ink is bubbled by driving the at least two electro-thermal conversion elements. Also, an ink-jet recording head using the ink-jet recording method, and an ink-jet recording apparatus using the ink-jet recording head are disclosed.

28 Claims, 16 Drawing Sheets

METHOD OF DRIVING A PLURALITY OF HEATING ELEMENTS AT SHIFTED TIMINGS

BACKGROUND OF THE INVENTION

1. Field of the Invention

The present invention relates to an ink-jet recording head having, in a single ink channel, a plurality of heating elements which can be independently driven. Furthermore, the present invention relates to an ink-jet recording method and apparatus using such ink-jet recording head.

2. Related Background Art

Most ink-jet recording apparatuses are known as printing apparatuses for printers, facsimile apparatuses, wordprocessors, copying machines, and the like. Of such apparatuses, an ink-jet recording apparatus that ejects ink by bubbles produced using heat energy as energy for ink ejection has recently become popular. As another application of an ink-jet recording apparatus of this type, an ink-jet printing apparatus for printing a predetermined pattern, design, synthesized image, or the like on cloth has become popular recently.

An ink-jet recording head used in the above-mentioned ink-jet recording apparatus uses electro-thermal conversion elements (to be also referred to as heaters hereinafter) as means for producing heat energy, and most ink-jet recording heads adopt an arrangement (to be also referred to as a single-heater arrangement hereinafter) that comprises a single heater in correspondence with a single ink channel. In contrast to this, some heads comprise a plurality of heaters in correspondence with a single ink channel (to be also referred to as a multi-heater arrangement hereinafter) for the following merits. Such head uses a plurality of heaters for the purpose of widening the range in which the ink ejection amount can be changed to attain gradation expression, and the ejection amount is changed by selecting the heaters to be driven or the number of heaters to be driven.

In one example of the arrangement, a plurality of heaters are arranged along the ink ejection direction in an ink channel communicating with an ejection orifice. By selecting the heaters to be driven or the number of heaters to be driven, the distances between the heaters to be driven and the ejection orifice are varied, thereby changing the ejection amount.

In another arrangement, a plurality of heaters having different surface areas are arranged in an ink channel, and the ink ejection amount is changed by selecting the heaters to be driven or the number of heaters to be driven as in the former arrangement. For example, such arrangement is disclosed in Japanese Patent Application Laid-Open No. 55-132259.

However, some problems remain unsolved to realize the above-mentioned multi-heater ink-jet recording head.

First, it is required to improve landing precision by improving the ink ejection velocity so as not only to vary the ink ejection amount but also to accomplish higher-quality recording. In order to achieve high-speed recording, the refill frequency of ink into the ink channel must also be improved.

Second, compatibility with single-heater ink-jet recording heads poses another problem. Most ink-jet recording heads are commercially available as expendables that are detachably mounted on ink-jet recording apparatuses in the form of cartridges that integrate tanks for storing ink, and are exchanged with new ones when ink in the tank is used up.

On the other hand, an ink-jet recording apparatus which uses a single-heater ink-jet recording head has no arrangement for controlling driving of a multi-heater ink-jet recording head, but the multi-heater ink-jet recording head may be mounted on such ink-jet recording apparatus. For this reason, it is preferable to provide compatibility between the multi- and single-heater ink-jet recording heads so as to avoid confusion in the market.

SUMMARY OF THE INVENTION

It is an object of the present invention to provide an ink-jet recording method, ink-jet recording head, and ink-jet recording apparatus, which can improve the ejection characteristics represented by the ejection velocity and ejection amount when an ink-jet head having a plurality of electro-thermal conversion elements in correspondence with a single ink channel is used, and ink is ejected by driving the plurality of electro-thermal conversion elements.

It is another object of the present invention to provide an ink-jet recording method, ink-jet recording head, and ink-jet recording apparatus, which can realize high-speed recording by improving the refill frequency.

It is still another object of the present invention to provide an ink-jet recording head which is compatible with a head in which a single heater is arranged in correspondence with a single ink channel.

Other objects of the present invention will be understood from the following description of the embodiments.

An ink-jet recording method of the present invention uses an ink-jet recording head in which a plurality of electro-thermal conversion elements that can be independently driven are arranged in an ink channel communicating with an ejection orifice, and which bubbles ink by driving the electro-thermal conversion elements and ejects the ink from the ejection orifice, and relates to how to drive at least two of the electro-thermal conversion elements when the ink is bubbled by driving these electro-thermal conversion elements.

In one method, ink is ejected from the ejection orifice by relatively shifting the bubbling timings defined upon driving the at least two electro-thermal conversion elements within the range in which the ejection characteristics of ink do not deteriorate as compared to a case wherein the ink is bubbled by simultaneously driving the at least two electro-thermal conversion elements, e.g., within the range in which the ejection velocity of ink does not decrease, thus recording on a recording medium.

In another method, ink is ejected from the ejection orifice by relatively shifting the drive timings of the at least two electro-thermal conversion elements for bubbling ink within the range in which the ejection characteristics of ink do not deteriorate as compared to a case wherein the ink is bubbled by simultaneously driving the at least two electro-thermal conversion elements, e.g., within the range in which the ejection velocity of ink does not decrease, thus recording on a recording medium.

Alternatively, ink is ejected from the ejection orifice by relatively shifting the bubbling timings defined upon driving the at least two electro-thermal conversion elements within the range in which the ink ejection amount does not decrease as compared to a case wherein the ink is bubbled by simultaneously driving the at least two electro-thermal conversion elements, thus recording on a recording medium.

Or, ink is ejected from the ejection orifice by relatively shifting the drive timings of the at least two electro-thermal conversion elements for bubbling ink within the range in which the ink ejection amount does not decrease as compared to a case wherein the ink is bubbled by simultaneously driving the at least two electro-thermal conversion elements, thus recording on a recording medium.

Alternatively, if AT represents the relative shift period between the bubbling timings upon driving the individual electro-thermal conversion elements, ink is ejected from the ejection orifice by relatively shifting the bubbling timings within the following range to record on a recording medium:

$$0<|\Delta T|<0.5\ \mu s$$

An ink-jet recording head and ink-jet recording apparatus of the present invention have the above-mentioned means for shifting the bubbling timings of the electro-thermal conversion elements.

The present inventors found that macroscopically the ink ejection velocity tends to decrease as the shift period between the bubbling timings becomes larger when ink is ejected by driving two of a plurality of electro-thermal conversion elements arranged in an ink channel, and when the bubbling timings are shifted. When the ejection velocity and ejection amount were microscopically measured by decreasing the shift period between the bubbling timings, the present inventors found a new phenomenon in that the ink ejection velocity and ejection amount do not become maximum when ink is bubbled by simultaneously driving the two electro-thermal conversion elements, but assume maximal values when the bubbling timings are shifted by a period as very short as 0.1 to 0.3 $\mu$s.

When the bubbling timings upon driving the electro-thermal conversion elements are shifted by a predetermined period by utilizing this phenomenon, the ink ejection velocity and ejection amount can be increased while energy applied to the electro-thermal conversion elements is the same as that upon simultaneously driving them. As a result, landing precision or the like can be improved.

As will be described in the following embodiments, the refill frequency can be greatly improved depending on the layout of the electro-thermal conversion elements or their bubbling order, and high-speed recording can also be realized.

Since the drive timings of the electro-thermal conversion elements, and the ink bubbling timings have a predetermined relationship therebetween, the same control as for the ink bubbling timings applies to the drive timings of the electro-thermal conversion elements.

As a drive pulse of each electro-thermal conversion element, a single pulse normally used, and a double pulse made up of a pre-heat pulse for controlling bubbling of ink by controlling the temperature distribution of ink in the vicinity of the electro-thermal conversion element, and a main heat pulse for bubbling the ink, are known. All the electro-thermal conversion elements may be driven by an identical pulse or a single pulse may be applied to at least one of two or more electro-thermal conversion elements to be driven and a double pulse may be applied to other elements, so as to enhance the size differences of dots upon gradation expression. In the latter case, when electro-thermal conversion elements are arranged at different distances from each ejection orifice, it is preferable to apply a single pulse to the electro-thermal conversion element near the ejection orifice, and to apply a double pulse to the electro-thermal conversion element far from the ejection orifice.

Furthermore, the ink-jet recording head and ink-jet recording apparatus of the present invention comprise means for relatively shifting the bubbling timings to obtain the same ink ejection velocity or ejection amount as that obtained when ink is bubbled by simultaneously driving the electro-thermal conversion elements. With this arrangement, even when the ink-jet recording head of the present invention is mounted on either an ink-jet recording apparatus which uses an ink-jet recording head having one electro-thermal conversion element in correspondence with one ink channel or even when an ink-jet recording head having one electro-thermal conversion element in correspondence with one ink channel is mounted on the ink-jet recording apparatus of the present invention, the ink ejection characteristics remain nearly the same, and the apparatus can record without posing any problems.

DESCRIPTION OF THE PREFERRED EMBODIMENTS

In the present invention, the bubbling timings upon driving a plurality of electro-thermal conversion elements in a single ink channel are basically shifted. Upon bubbling, when identical drive pulses are applied to the individual electro-thermal conversion elements while shifting timings, the shift timings nearly match those of the bubbling timings. Hence, in the following description, assume that identical drive pulses are applied to the individual electro-thermal conversion elements, and the shift of the drive timings is nearly equal to that of the bubbling timings, unless otherwise specified. That is, when identical drive pulses are applied to the individual electro-thermal conversion elements, the drive timings and bubbling timings are used in substantially the same sense. Of course, the present invention can also be applied to a case wherein different drive pulses are applied to the individual electro-thermal conversion elements. In this case, however, an earlier drive pulse does not always cause earlier bubbling. This is because, for example, when ink is bubbled by applying a pre-heat pulse and main heat pulse, bubbling is controlled by the pre-heat pulse.

The embodiments of the present invention will be described hereinafter with reference to the accompanying drawings.

(First Embodiment)

Figure 1:
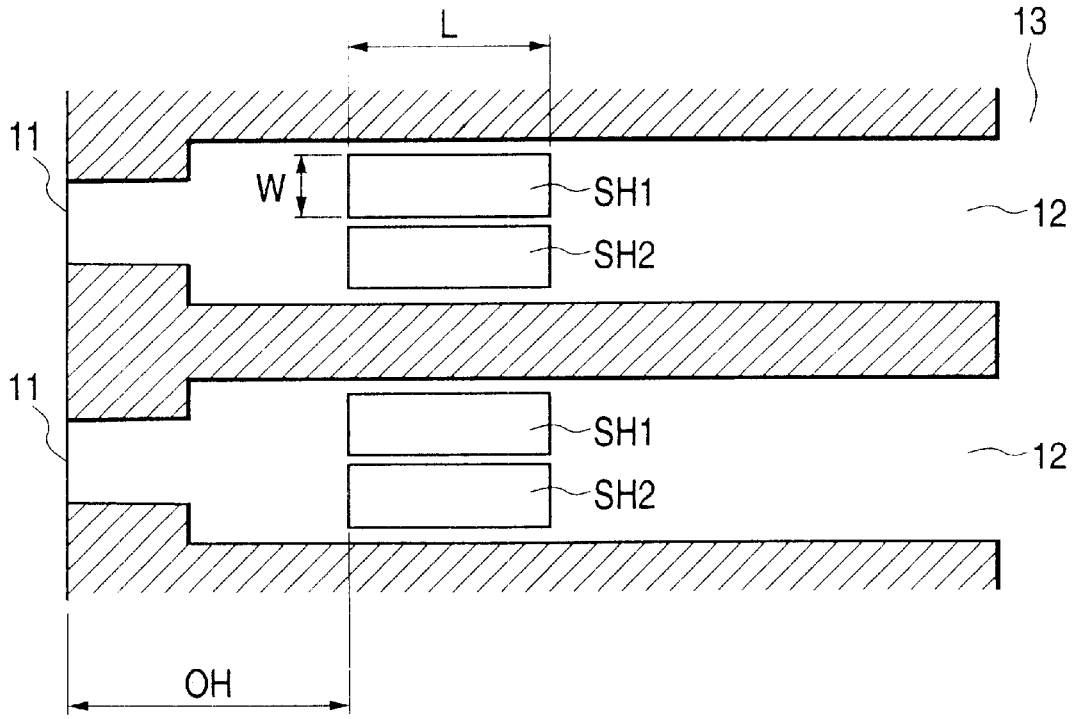
FIG. 1 is a sectional view of an ink channel portion in the first embodiment of an ink-jet recording head according to the present invention.

FIG. 1 is a sectional view of an ink channel portion in the first embodiment of an ink-jet recording head according to the present invention.

In this ink-jet recording head, a plurality of parallel ink channels 12 communicating with ejection orifices 11 are arranged at a density of 360 dpi. In each ink channel 12, two heaters (electro-thermal conversion elements) SH1 and SH2 are juxtaposed in the widthwise direction of the ink channel 12. In this embodiment, each ink channel 12 has a width of 58 $\mu$m and a height of 40 $\mu$m. The heaters SH1 and SH2 have equal lengths L (130 $\mu$m) and width W (17 $\mu$m). Also, distances OH from the ejection orifice 11 to the heaters SH1 and SH2 are equal to each other, and are set at 170 $\mu$m. The distance between the two heaters SH1 and SH2 is 6 $\mu$m.

The end of each ink channel 12 on the side opposite to the ejection orifice 11 is connected to an ink chamber 13 common to the ink channels 12, and the distance from the ejection orifice 11 to the ink chamber 13 is set at 400 $\mu$m. This is to refill ink from the ink chamber 13 to the ink channels 12 at high speed, i.e., to increase the refill frequency.

Ink supplied from a tank (not shown) is temporarily held in the ink chamber 13, enters each ink channel 12 by a capillary phenomenon, and forms a meniscus at the ejection orifice 11 to maintain the filled state of the ink channel 12. In this state, by driving the heaters SH1 and SH2 to apply heat energy to the ink, the ink undergoes changes in state with abrupt changes in volume (formation of a bubble), and the ink is ejected from the ejection orifice 11 by an action force based on the changes in state.

The front edge portions (the edge portions on the ejection orifice 11 side) of the heaters SH1 and SH2 are connected to a common electrode (not shown), and their rear edge portions (the edge portions on the ink chamber 13 side) are respectively connected to individual electrodes (not shown), so the heaters SH1 and SH2 can be independently driven. The ink ejection amount obtained when one heater SH1 alone is driven is nearly equal to that obtained when the other heater SH2 alone is driven, about 20 pl. By driving the two heaters SH1 and SH2, the ink ejection amount is nearly doubled, i.e., about 40 pl.

Figure 2:
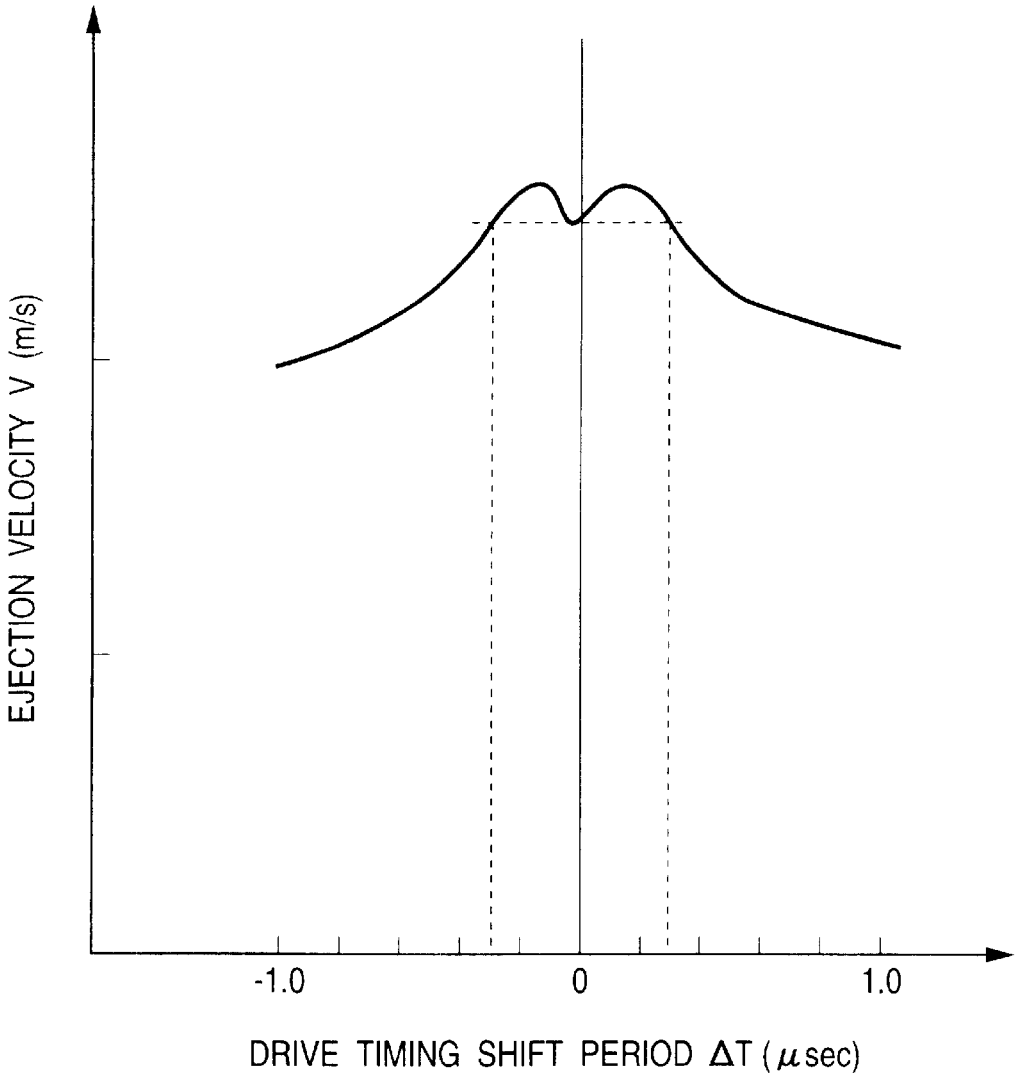
FIG. 2 is a graph showing the relationship between the drive timing shift period of the individual heaters and the ejection velocity in the ink-jet recording head shown in FIG. 1.

The present inventors measured the ejection characteristics obtained when ink was ejected by shifting the drive timings of the two heaters SH1 and SH2 by 0.1-$\mu$s periods. As the relationship between the drive timing shift period and the ejection velocity as one index representing the ejection characteristics, the result shown in FIG. 2 is obtained. As the ejection velocity is higher, the ejection characteristics are better. In FIG. 2, the abscissa plots the drive timing shift period $\Delta T$ of one heater SH1 with reference to the other heater SH2. More specifically, when one heater SH1 is driven after the other heater SH2 is driven, the shift period is expressed by a positive value; conversely, when one heater SH1 is driven before the other heater SH2 is driven, the shift period is expressed by a negative value. Also, the ordinate plots the ink ejection velocity v.

As a result, the present inventors found, under the assumption that the ink ejection velocity v obtained upon simultaneously driving the heaters SH1 and SH2 assumes a minimal value, a new phenomenon in that the ejection velocity v assumes a maximal value upon driving the heaters SH1 and SH2 by shifting their drive timings by 0.1 to 0.2 $\mu$s, and assumes the same value as that obtained upon simultaneously driving the heaters SH1 and SH2 when the heaters are driven by shifting their drive timings by 0.3 $\mu$s. The relationship between the drive timing shift period $\Delta T$ and the ejection velocity v is roughly symmetrical about the simultaneous drive timing. Although not shown in the graph, a similar result was obtained in respect of the ink ejection amount. The ink ejection amount is another index representing the ink ejection characteristics; as the ejection amount is larger, the ejection characteristics are better.

Figure 3:
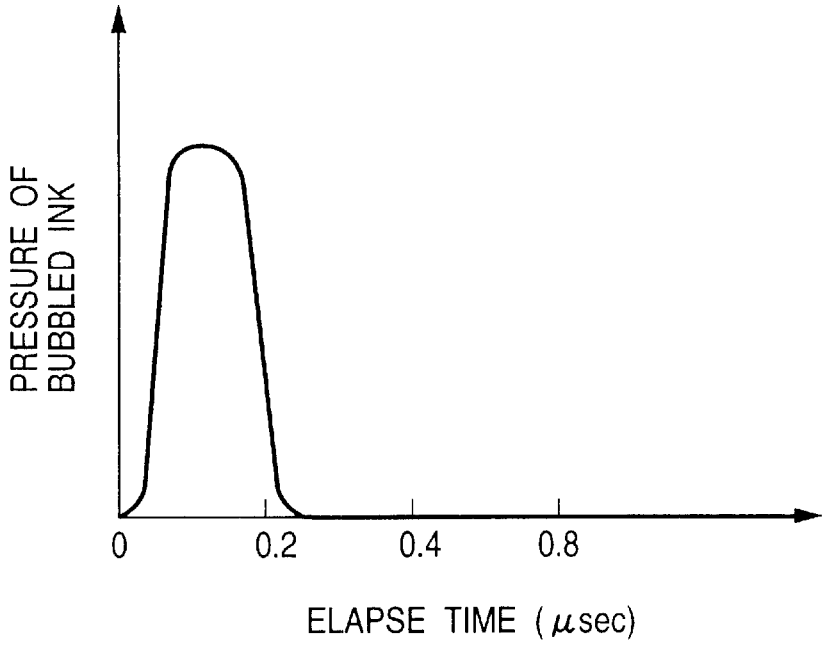
FIG. 3 is a graph showing the relationship between the elapse time from the beginning of bubbling and the pressure of bubbled ink when ink is bubbled by driving a single heater.
Figure 4:
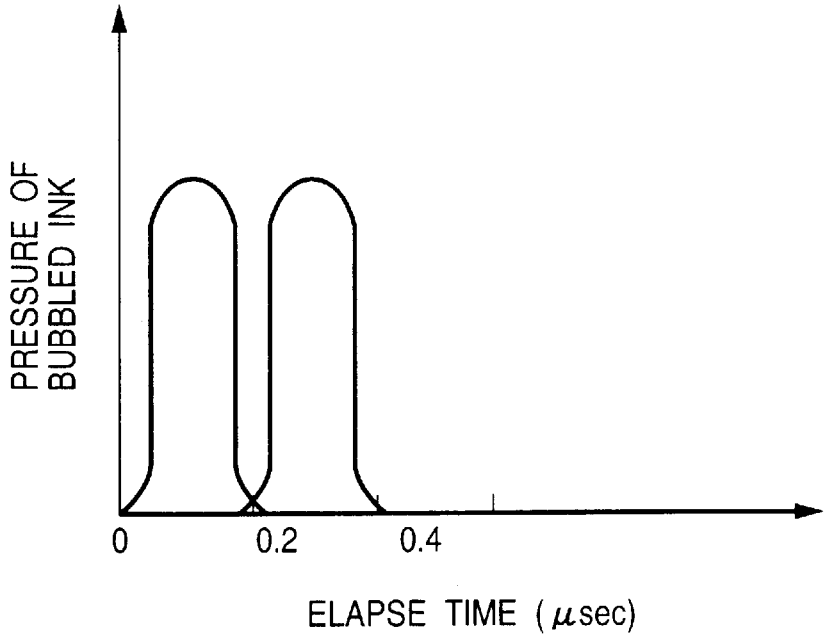
FIG. 4 is a graph showing the relationship between the elapse time from the beginning of bubbling and the pressure of bubbled ink when two heaters are driven so that they have an identical peak value of the pressure of bubbled ink.

FIGS. 3 and 4 are graphs showing the pressure of bubbled ink when ink is bubbled by applying a voltage to a heater, and the abscissa plots the elapse time from the beginning of bubbling.

In general, when ink is bubbled by applying a voltage to a heater, the pressure peak upon bubbling has a width of about 0.1 to 0.2 $\mu$s, as shown in FIG. 3. This fact may, in large part, account for the above-mentioned phenomenon.

That is, probably, at the instance when ink is bubbled by simultaneously driving the two heaters SH1 and SH2, the fluid flows or bubbles are produced by the bubbling forces on the heaters SH1 and SH2 or they collide against each other between the two heaters SH1 and SH2, and energy losses produced by them lower the ejection velocity and ejection amount.

On the other hand, presumably, by driving the two heaters so that they have an identical peak value of the pressure of bubbling, as shown in FIG. 4, the next bubbling brings about efficient ink ejection before the viscous resistance due to the flow of ink on the ejection orifice side of the heater after bubbling acts. Furthermore, possibly, ink slightly protrudes from the ejection orifice upon bubbling by the first heater, and the inertial resistance of ink on the ejection orifice side of the heater is reduced upon next bubbling.

It follows from the above that when the two heaters SH1 and SH2 are driven while shifting their drive timings by 0.1 to 0.2 μs, the ejection velocity and ejection amounts can be increased as compared to those obtained by simultaneously driving them, and the landing precision of ink can be improved. In addition, since the drive voltage and drive period of the two heaters SH1 and SH2, i.e., input energy remains the same as that upon simultaneously driving the two heaters SH1 and SH2, ink can be efficiently ejected consequently.

The means for shifting the drive timings of the heaters SH1 and SH2 may be arranged in either the ink-jet recording head or the recording apparatus.

In the recording apparatus, the two following application schemes of drive pulses to the heaters SH1 and SH2 are available: a so-called single-pulse scheme for applying drive pulses every time ink is bubbled, and a double-pulse scheme for applying a drive pulse with a pulse width which is too short to cause bubbling prior to application of a drive pulse for bubbling so as to preheat ink before ejection. Hence, when the drive timings of the heaters SH1 and SH2 or bubbling timings by the heaters SH1 and SH2 are to be shifted in the recording apparatus, the drive pulses to be applied to the heaters SH1 and SH2 are roughly classified into four cases shown in FIGS. 5A to 5D.

Figure 5A:
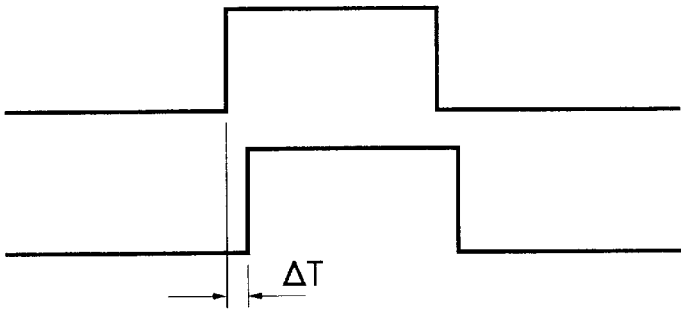
FIGS. 5A, 5B, 5C and 5D are charts showing examples of drive pulses to be applied to two heaters.

FIG. 5A shows an example of the single-pulse scheme. In this example, the application timings of drive pulses to be applied to the heaters SHI and SH2 are merely shifted. For example, drive pulses at a voltage of 27 V and having a pulse width of 5 us are applied to the heaters SH1 and SH2 with the above-mentioned size while being shifted by ΔT.

Figure 5B:
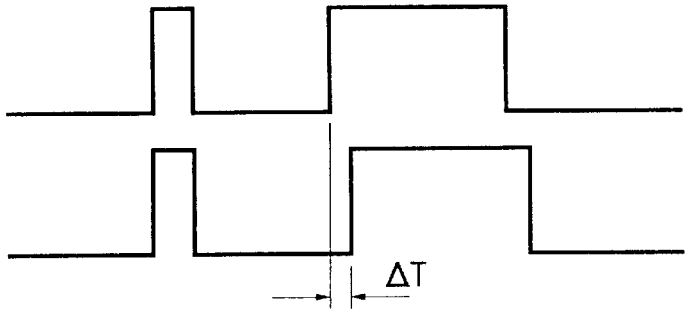
Figure 5C:
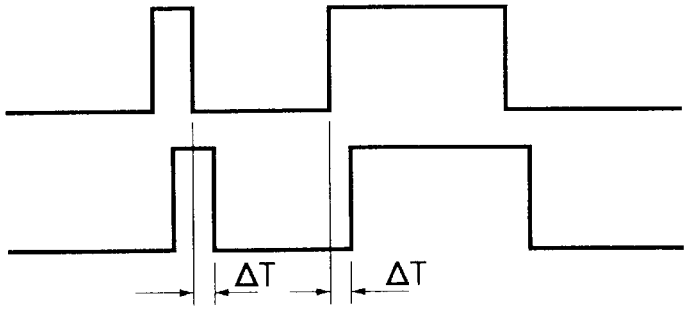

FIGS. 5B and 5C show examples of the double-pulse scheme. In FIGS. 5B and 5C, a pulse with a large pulse width is called a main heat pulse, and is the one for bubbling ink. On the other hand, a pulse with a small pulse width is called a preheat pulse, and is the one applied to preheat ink prior to application of the main heat pulse. The ink is not bubbled by the preheat pulse.

In the double-pulse scheme, as is known, even when the pulse width as a sum of those of the preheat pulse and main heat pulse equals that in the single-pulse scheme, the ink ejection amount or ejection velocity can be increased as compared to the single-pulse scheme. Hence, the double-pulse scheme is effective for improving the ink ejection amount or ejection velocity.

In this manner, since the double-pulse scheme applies a preheat pulse which is not used in bubbling of ink, the driving timings of preheat pulses may or may not be shifted. More specifically, the double-pulse scheme includes two methods, i.e., the drive timings of preheat pulses are not shifted and the drive timings of main heat pulses alone are shifted by ΔT (FIG. 5B), and the drive timings of both preheat and main heat pulses are shifted by ΔT (FIG. 5C). Of course, when the means for shifting the drive timings is arranged in the ink-jet recording head, the heaters SH1 and SH2 are driven by the method shown in FIG. 5C.

Figure 5D:
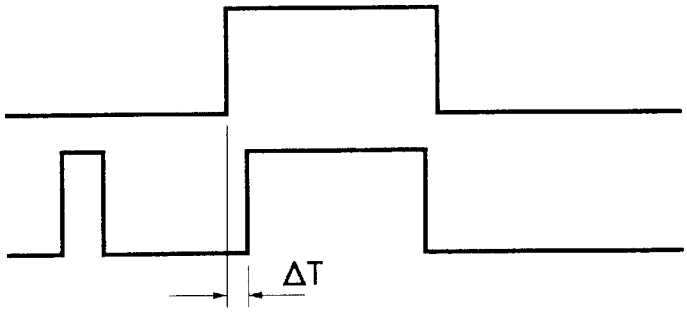

FIG. 5D shows a drive scheme as a combination of the single-pulse scheme and double-pulse scheme. In this case, one heater is driven by the single-pulse scheme, and the other heater is driven by the double-pulse scheme. In this drive scheme, since the preheat pulse applied to the heater driven by the double-pulse scheme does not contribute to bubbling of ink, the shift period ΔT means that from the drive timing of the main heat pulse.

This drive scheme is effective for a case wherein gradation expression is done by varying the ink ejection amount in two steps. To obtain a small ejection amount, one heater alone is driven to eject ink, while to obtain a large ejection amount, both heaters are driven to eject ink. As described above, by utilizing the fact that the ink ejection amount obtained by driving the heaters by the double-pulse scheme becomes larger than that obtained by driving the heaters by the single-pulse scheme, the heater to be driven to obtain a small ejection amount is driven by the single-pulse scheme, and the other heater is driven by the double-pulse scheme.

With this scheme, a small dot and large dot can have a sufficient difference, and two-step gradation expression can be satisfactorily executed. To obtain a large ejection amount, both heaters may be driven by the double-pulse scheme. However, in this case, one heater must be selectively driven by the single-pulse scheme and the double-pulse scheme, and the drive circuit requires a very complicated structure. In addition, it is confirmed that the ink ejection amount at that time roughly equals that obtained by driving the heaters by the scheme shown in FIG. 5D. Therefore, the drive scheme shown in FIG. 5D is particularly practical to attain satisfactory gradation expression.

When ink ejection is done by mounting the above-mentioned ink-jet recording head on an ink-jet recording apparatus that uses a single-heater ink-jet recording head having one heater in correspondence with one ink channel, the two heaters SH1 and SH2 are driven at the same time. In this case, if the ink-jet recording head of this embodiment is designed to have the same ejection characteristics such as the ejection velocity, ejection amount, and the like as those of the single-heater ink-jet recording head, the total area of the heaters SH1 and SH2 becomes larger than that of the single-heater ink-jet recording head, resulting in an increase in input energy.

To solve this problem, when a delay circuit for shifting the drive timings of the two heaters SH1 and SH2 is arranged in the ink-jet recording head to improve the ejection characteristics, and the total area of the heaters is reduced accordingly, substantially the same ejection characteristics as those of the conventional ink-jet recording head can be obtained while the input energy remains the same. As a consequence, even when the ink-jet recording head of this embodiment is mounted on a single-heater ink-jet recording apparatus, it can be used without posing any problems.

(Second Embodiment)

Figure 6:
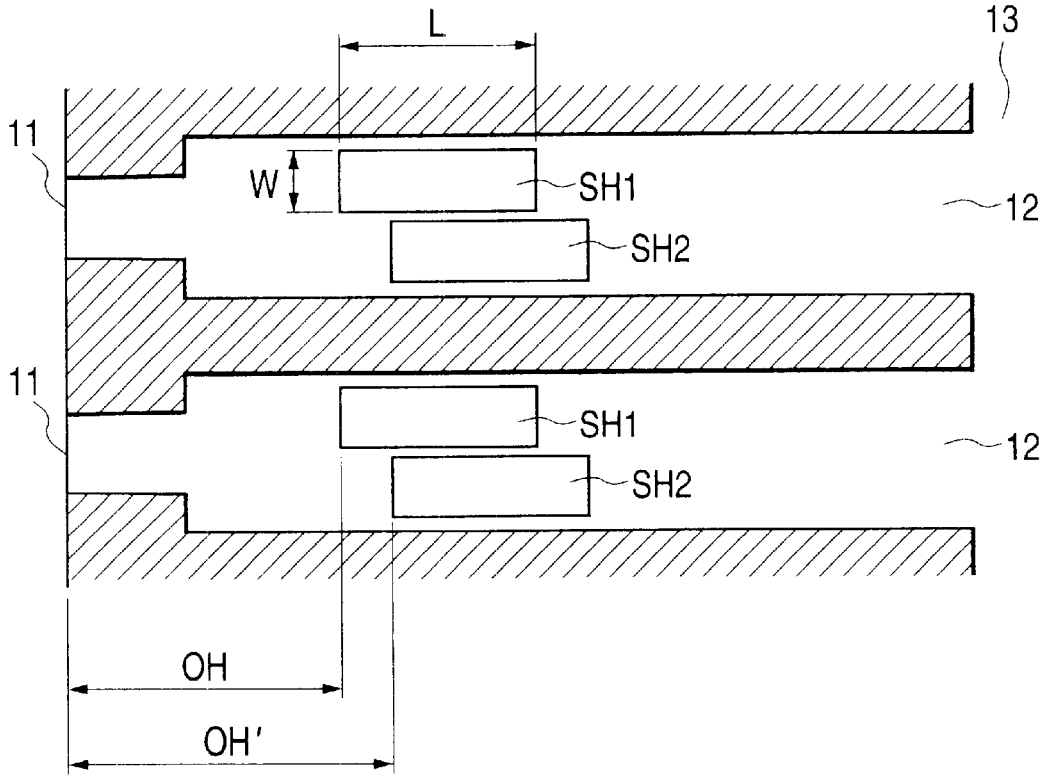
FIG. 6 is a sectional view of an ink channel portion in the second embodiment of an ink-jet recording head according to the present invention.

FIG. 6 is a sectional view of an ink channel portion in the second embodiment of an ink-jet recording head according to the present invention.

In this embodiment, the positions of two heaters SH1 and SH2 with respect to an ejection orifice 11 are shifted. More specifically, the two heaters SH1 and SH2 are arranged so that the distance OH between one heater SH1 and the ejection orifice 11 becomes shorter than the distance OH' between the other heater SH2 and the ejection orifice 11. In this embodiment, OH=110 μm, and OH'=165 μm. The lengths L and widths W of the heaters SH1 and SH2, the width of an ink channel 12, and the like are the same as those in the first embodiment. In the following description of an example in which the positions of the heaters SH1 and SH2 are shifted, the heater closer to the ejection orifice 11 will be referred to as a front heater SH1, and the heater farther from the orifice 11 will be referred to as a rear heater SH2, for the sake of simplicity.

Figure 7A:
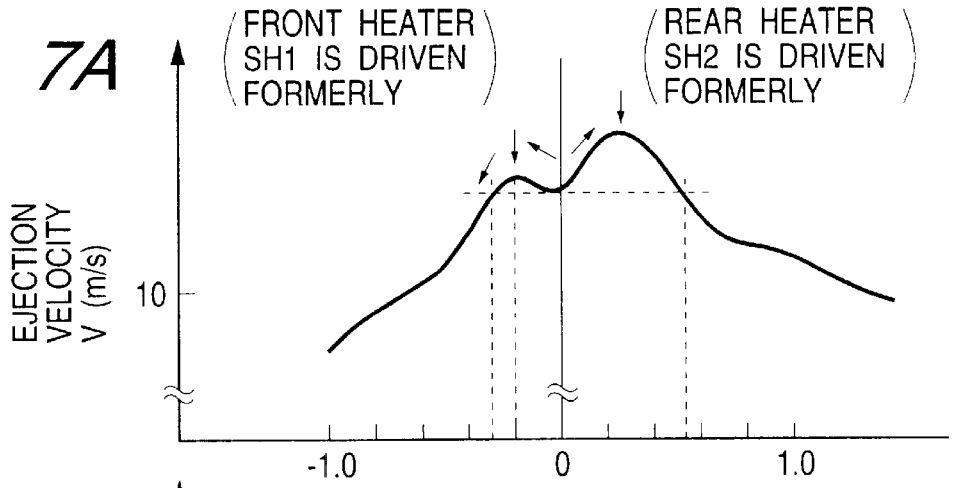
FIGS. 7A, 7B and 7C are graphs showing the relationship of the ejection velocity, ejection amount, and refill frequency with respect to the drive timing shift period of the individual heaters in the ink-jet recording head shown in FIG. 6.
Figure 7B:
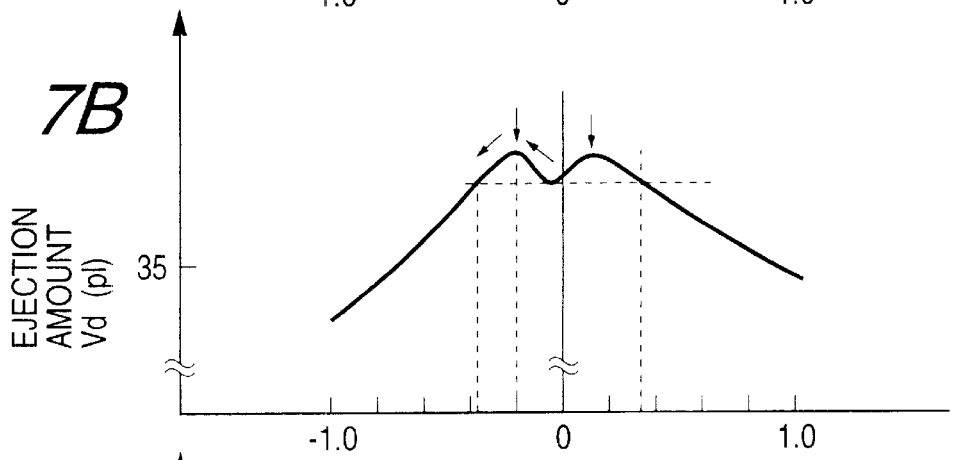
Figure 7C:
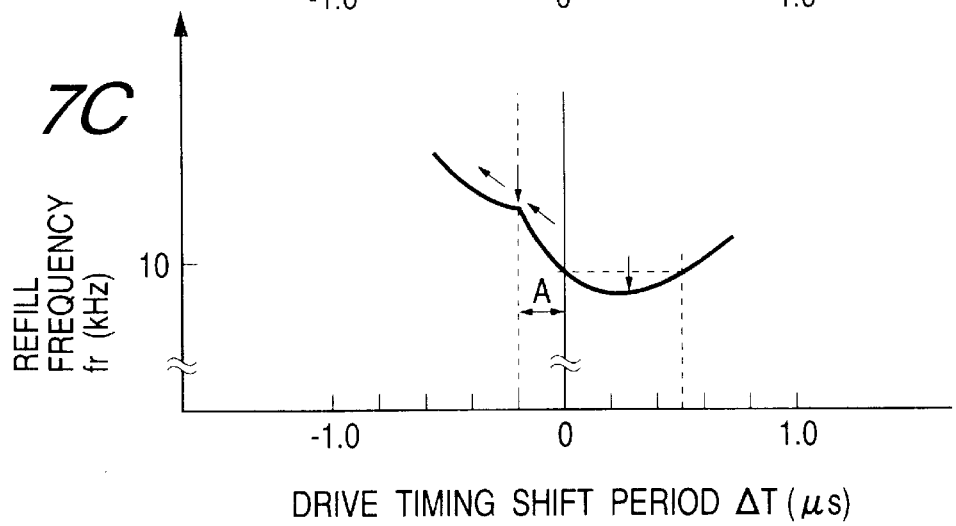

In the above-mentioned ink-jet head, the ink ejection velocity v and the ejection amount Vd with respect to the drive timing shift period ΔT upon applying pulses with an identical waveform to the heaters SH1 and SH2 were measured. Furthermore, in this case, the refill frequency fr of the heaters SH1 and SH2 with respect to the drive timing shift period ΔT was also measured. FIGS. 7A to 7C show these measurement results. In FIGS. 7A to 7C, the abscissa plots the drive timing shift period of the front heater SH1 with reference to the rear heater SH2.

As for the ejection velocity v, as can be seen from FIG. 7A, the ejection velocity v assumes maximal values on both sides of a minimal value obtained upon simultaneously driving the two heaters SH1 and SH2, and the drive timing shift period ΔT corresponding to the maximal value obtained upon driving the rear heater SH2 first becomes larger than that obtained upon driving the front heater SH1 first. Also, the maximal value of the ejection velocity v obtained upon driving the rear heater SH2 first becomes larger than that obtained upon driving the front heater SH1 first.

More specifically, when the front heater SH1 is driven first, the ejection velocity v assumes a maximal value when the drive timing shift period ΔT is 0.2 μs, and assumes a value nearly equal to that obtained upon simultaneously driving the two heaters SH1 and SH2 when the period ΔT is 0.3 μs. When the drive timing shift period ΔT exceeds 0.3 μs, the ejection velocity v gradually drops. Conversely, when the rear heater SH2 is driven first, the ejection velocity v assumes a maximal value when the drive timing shift period ΔT falls within the range from 0.2 to 0.3 μs, and assumes a value nearly equal to that obtained upon simultaneously driving the two heaters SH1 and SH2 when the period ΔT is 0.5 μs. When the drive timing shift period ΔT exceeds 0.5 μs, the ejection velocity v gradually falls.

This may be ascribed to the fact that if the rear heater SH2 is driven first, a force obtained by driving the front heater SH1 additionally acts on ink while the components directed toward the ejection orifice 11 of the force that acts on the ink upon driving the rear heater SH2 also act on the ink.

As for the ejection amount Vd, as can be seen from FIG. 7B, contrary to the ejection velocity v, the driving timing shift period ΔT corresponding to a maximal value upon driving the front heater SH1 first becomes slightly larger than that obtained upon driving the rear heater SH2 first, and the maximal value of the ejection amount Vd obtained upon driving the front heater SH1 first is also slightly larger than that obtained upon driving the rear heater SH2 first.

More specifically, when the front heater SH1 is driven first, the ejection amount Vd assumes a maximal value when the drive timing shift period ΔT is 0.2 μs, and assumes a value nearly equal to that obtained upon simultaneously driving the two heaters SH1 and SH2 when the period ΔT falls within the range from 0.3 to 0.4 μs. When the drive timing shift period ΔT exceeds 0.4 μs, the ejection velocity v gradually decreases. Conversely, when the rear heater SH2 is driven first, the ejection amount Vd assumes a maximal value when the drive timing shift period ΔT falls within the range from 0.1 to 0.2 μs, and assumes a value nearly equal to that obtained upon simultaneously driving the two heaters SH1 and SH2 when the period ΔT is 0.3 μs. When the drive timing shift period ΔT exceeds 0.3 μs, the ejection velocity v gradually decreases.

Finally, the refill frequency fr shows a tendency different from those of the ejection velocity v and ejection amount Vd, as can be seen from FIG. 7C.

That is, when the front heater SH1 is driven first, the refill frequency fr has a point of inflection when the drive timing shift period ΔT is 0.2 μs, but the refill frequency fr tends to gradually increase as |ΔT| becomes larger. Conversely, when the rear heater SH2 is driven first, the refill frequency gradually decreases until the drive timing shift period ΔT is 0.2 to 0.3 μs, and assumes a minimal value when the drive timing shift period ΔT falls within the range from 0.2 to 0.3 μs. When the drive timing shift period ΔT exceeds 0.3 μs, the refill frequency fr gradually increases. On the other hand, when the drive timing shift period ΔT is 0.5 μs, the refill frequency fr assumes a value nearly equal to that obtained upon driving the two heaters SH1 and SH2 simultaneously.

On the other hand, in the region A with the drive timing shift period ΔT falling within the range from −0.2 to 0 μs, i.e., when the front heater SH1 is driven 0 to 0.2 μs earlier than the rear heater SH2, the ejection velocity v, ejection amount Vd, and refill frequency fr all tend to increase. In other regions, the ejection velocity v and refill frequency fr have contrary tendencies.

As one reason for such tendency, it is assumed that since the rear heater SH2 is driven to bubble ink while the pressure of a bubble produced upon driving the first heater SH1 is high, the bubble produced upon driving the front heater SH1 serves as a wall, and the bubble produced upon driving the rear heater SH2 grows behind the bubble produced by the front heater SH1. This may have reduced the retreating amount of the meniscus at the ejection orifice 11 upon bubble vanishing.

As another reason, probably, even when the bubble produced upon driving the rear heater SH2 does not especially grow behind that produced by the front heater SH1, since the final bubble vanishing point corresponds to the rear heater SH2, the inertial resistance of ink from the effective bubble vanishing center of the two bubbles as a whole upon bubble vanishing toward the ejection orifice becomes large and, hence, the meniscus displacement upon bubble vanishing is reduced.

In order to examine the influence, on the ejection characteristics, of the shift distance between the two heaters SH1 and SH2 when the two heaters SH1 and SH2 are arranged to have different distances from the ejection orifice 11, as shown in FIG. 6, the position of the rear heater SH2 was fixed, that of the front heater SH1 was changed, and the ejection velocity v with respect to the drive timing shift period ΔT of the heaters SH1 and SH2 at that time was measured.

This measurement used three different samples shown in Table 1 below.

TABLE 1

| Sample | OH (μm) | OH' (μm) | ΔOH (μm) |
|---|---|---|---|
| S1 | 140 | 165 | 25 |
| S2 | 110 | | 55 |
| S3 | 90 | | 75 |

In Table 1, ΔOH is the shift distance between the front and rear heaters SH1 and SH2.

Figure 8:
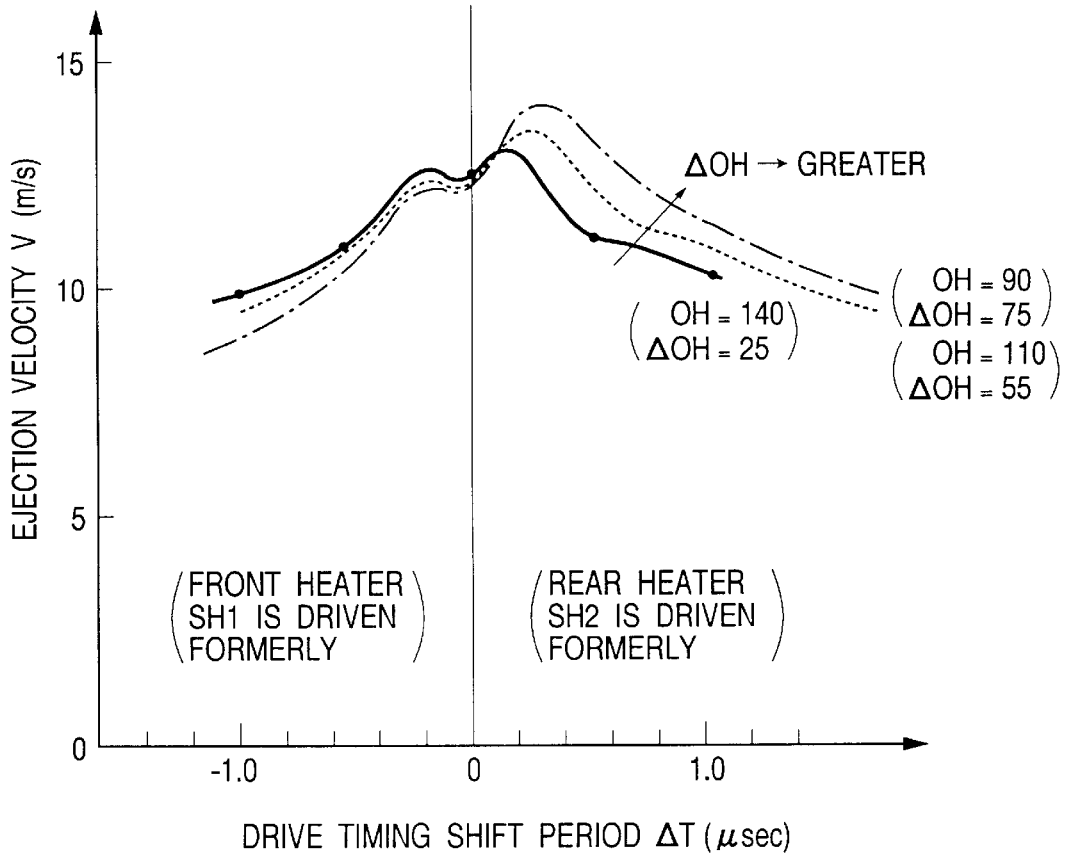
FIG. 8 is a graph showing the relationship of the ejection velocity with respect to the drive timing shift period of the individual heaters when the positions of rear heaters are fixed and those of front heaters are changed.

FIG. 8 is a graph showing these measurement results. As is understood from FIG. 8, as ΔOH becomes larger, i.e., as the distance OH between the front heater SH1 and the ejection orifice 11 becomes smaller, the maximal value of the ejection velocity v obtained when the drive timing of the front heater SH1 is delayed increases, and the drive timing shift period ΔT corresponding to the maximal value becomes large. On the other hand, the maximal value of the ejection velocity v when the drive timing of the rear heater SH2 is delayed slightly decreases, and the drive time shift period ΔT at that time is about 0.1 to 0.2 μs and remains the same.

Figure 9:
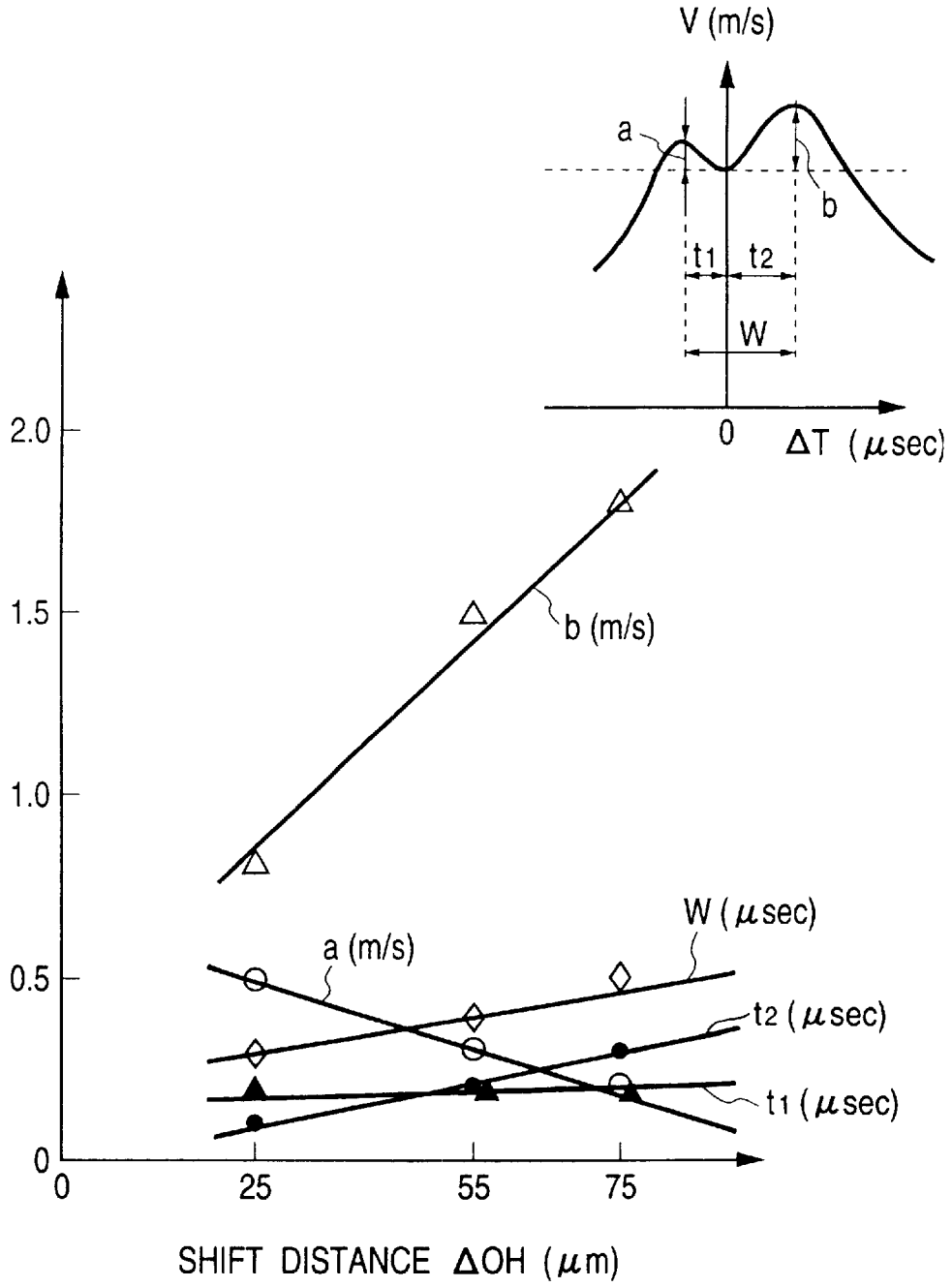
FIG. 9 is a graph showing the characteristic values associated with the ejection velocity with respect to the shift distances of the individual heaters when the positions of rear heaters are fixed, and those of front heaters are changed.

The graph in FIG. 9 shows that state plotting the heater shift distance AOH along the abscissa. In FIG. 9, line a represents the difference between the maximal value of the ejection velocity obtained when the front heater SH1 is driven first, and the ejection velocity obtained when the two heaters SH1 and SH2 are driven simultaneously. Also, line b represents the difference between the maximal value of the ejection velocity obtained when the rear heater SH2 is driven first, and the ejection velocity obtained when the two heaters SH1 and SH2 are driven simultaneously. Line t1 represents the drive timing shift period with respect to the rear heater SH2 at the maximal value of the ejection velocity when the front heater SH1 is driven first. Line t2 represents the drive timing shift period with respect to the front heater SH1 at the maximal value of the ejection velocity when the rear heater SH2 is driven first. Line W represents the period as a sum of t1 and t2.

As is apparent from the above description, when the two heaters SH1 and SH2 are arranged at different distances from the ejection orifice 11, the ejection velocity can be maximized by driving the rear heater SH2 first, and driving the front heater SH1 after an elapse of a predetermined period of time. Although a maximum ejection amount cannot be obtained at that time, the ejection amount can also be increased as compared to a case wherein the two heaters SH1 and SH2 are driven at the same time.

Conversely, the ejection velocity can also be improved by driving the front heater SH1 first and driving the rear heater SH2 after an elapse of a predetermined period of time, although it is lower than that obtained upon driving the rear heater SH2 first. In this case, however, the ejection amount and refill frequency can be improved as compared to a case wherein the rear heater SH2 is driven first. In particular, since the refill frequency can be improved greatly, this drive pattern is suitable for high-speed printing.

Note that the "predetermined period of time" varies depending on the layout of the heaters SH1 and SH2. For this reason, the drive timing shift period corresponding to a maximal value may be obtained by, e.g., experiments, and the heaters SH1 and SH2 may be driven by shifting the drive timings by the obtained period.

Figure 10:
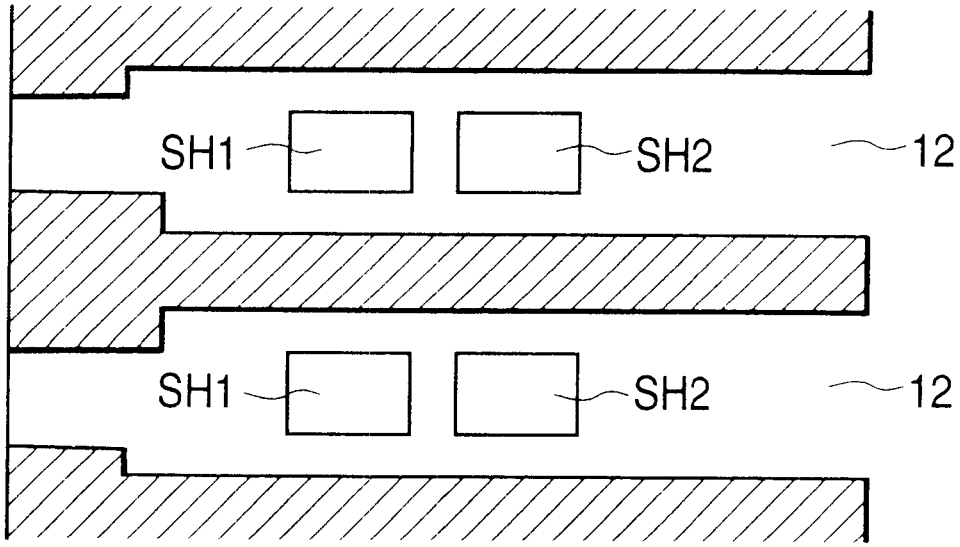
FIG. 10 is a sectional view of an ink channel portion of an ink-jet recording head, in which two heaters having the same size are arranged in series with each other along an ink channel.

In this embodiment, as shown in FIG. 6, the front and rear heaters SH1 and SH2 are arranged in the widthwise direction of the ink channel 12. Alternatively, when the difference between OH' and OH is larger than the length of the front heater SH1, the two heaters SH1 and SH2 may be serially arranged in the longitudinal direction of the ink channel 12, i.e., in the ink ejection direction, as shown in FIG. 10. Even when the heaters SH1 and SH2 are serially arranged, the same ejection characteristics as those obtained when they are parallelly arranged can be obtained.

(Third Embodiment)

In the above embodiment, identical drive pulses are applied to the two heaters SH1 and SH2. However, this embodiment will exemplify a case wherein the heaters are driven by combining the single-pulse scheme and double-pulse scheme shown in FIG. 5D. As an ink-jet recording head, a head in which two heaters SH1 and SH2 having nearly equal lengths and widths are arranged at different distances from an ejection orifice 11, as shown in FIG. 6, is used.

Figure 11A:
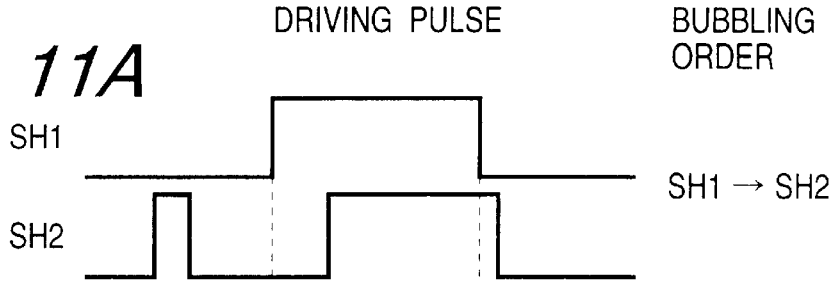
FIGS. 11A, 11B, 11C, 11D and 11E are charts showing pulse application patterns in the first case wherein one heater is driven by a single pulse and the other heater is driven by a double pulse.
Figure 11B:
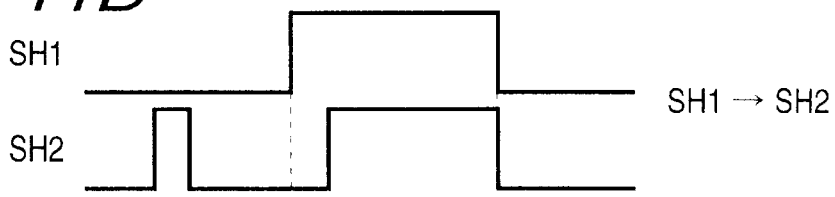
Figure 11C:
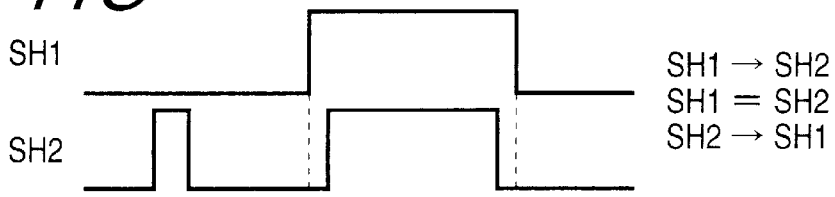
Figure 11D:
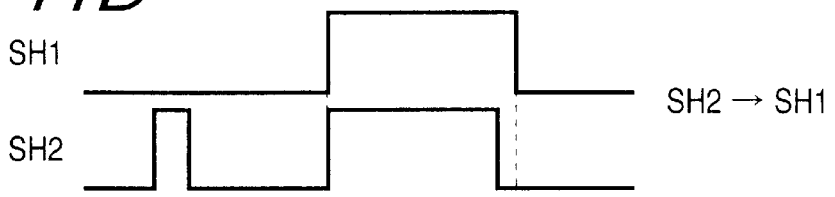
Figure 11E:
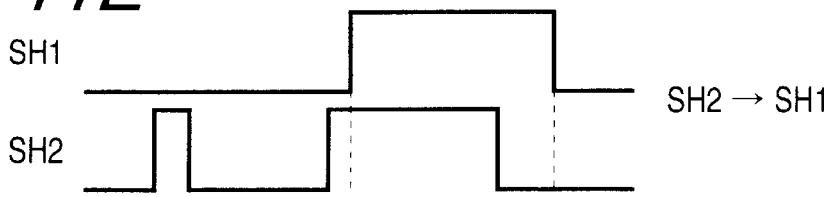
Figure 12A:
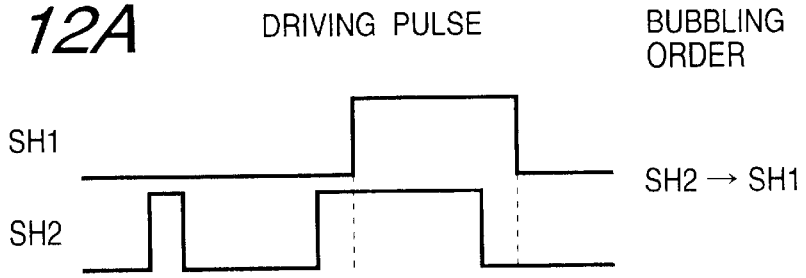
FIGS. 12A, 12B and 12C are charts showing pulse application patterns in the second case wherein one heater is driven by a single pulse and the other heater is driven by a double pulse.
Figure 12B:
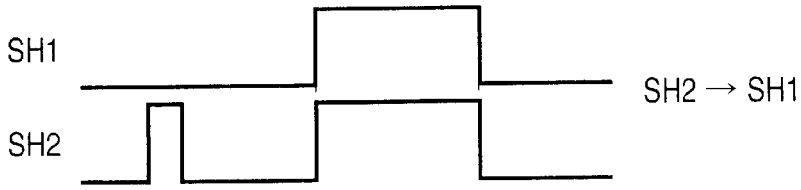
Figure 12C:
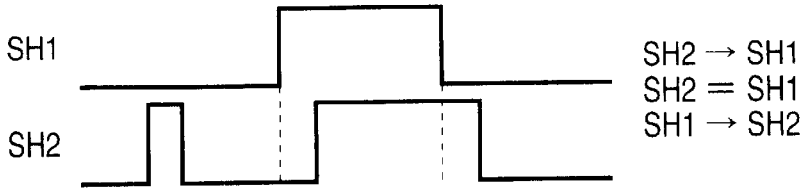

In this manner, the drive scheme as a combination of the single-pulse scheme and double-pulse scheme practically includes the first case wherein the total of the pulse widths of a preheat pulse and a main heat pulse of the double-pulse scheme is set to be equal to the pulse width of a single pulse, as shown in FIGS. 11A to 11E, and the second case wherein the pulse width of a main heat pulse of the double-pulse scheme is set to be equal to that of a single pulse, as shown in FIGS. 12A to 12C. Especially, in the first case, since equal energies are applied to the two heaters, the circuit loads for applying pulses also become equivalent to each other, and power supplies, wiring lines, and the like can be commonly designed.

Note that each of FIGS. 11A to 11E and FIGS. 12A to 12C exemplifies a case wherein a single pulse is applied to the front heater, and double pulses are applied to the rear heater. The present invention is not limited to such specific pulse application pattern, but the single pulse is preferably applied to the front heater for the following reason.

As described above, the drive scheme as a combination of the single-pulse scheme and double-pulse scheme is preferably used in gradation expression. A small dot is ejected by applying a single pulse. In order to form a clear difference between small and large dots, the ejection amount of the small dot is preferably stabilized. Stability of the ink ejection amount depends on the distance between the heater and ejection orifice, and changes in ink ejection amount are smaller as the distance between the heater and ejection orifice is smaller. Hence, in this embodiment, the single pulse is applied to the front heater.

In the first case shown in FIGS. 11A to 11E, and the second case shown in FIGS. 12A to 12C, the pulse application pattern for shifting the bubbling timings or drive timings is further classified into a plurality of patterns. These application patterns will be explained below.

The first case shown in FIGS. 11A to 11E will be described below. The first case includes five different application patterns. In view of the drive timings of main heat pulses, the front heater is driven first in FIGS. 11A to 11C, and the rear heater is driven first in FIG. 11E. By shifting the drive timings of main heat pulses of the two heaters within the range wherein the ink ejection characteristics do not deteriorate as compared to a case wherein ink is simultaneously bubbled by the two heaters (e.g., the ink ejection velocity or ejection amount does not decrease), the ink landing precision can be improved by increasing, e.g., the ejection velocity.

In FIG. 11D, both heaters are simultaneously driven by main heat pulses. However, since a preheat pulse is applied to the rear heater prior to the main heat pulse to preheat ink, the ink portion on the rear heater is bubbled first. Likewise, although the front heater is driven first in FIG. 11C, at a given shift period between the drive timings of the two heaters, the ink portions on the two heaters are simultaneously bubbled and that shift period provides a boundary between a case wherein the ink portion on the front heater is bubbled first and a case wherein the ink portion on the rear heater is bubbled first. In sum, in terms of the bubbling timings, the ink portion on the front heater is bubbled first in FIGS. 11A and 11B, the ink portion on the rear heater is bubbled first in FIGS. 11D and 11E, and the bubbling order of ink portions on the front and rear heaters changes depending on the preheat condition, ambient temperature, and the like in FIG. 11C. The ink landing precision can also be improved by shifting the bubbling timings defined upon driving the two heaters within the range in which the ink ejection velocity or ejection amount does not become smaller than that obtained when the ink is simultaneously bubbled by the two heaters.

The second case shown in FIGS. 12A to 12C will be described below. The second case includes three different application patterns. In view of the drive timings, the rear heater is driven first in FIG. 12A, and the front heater is driven first in FIG. 12C. By shifting the drive timings of the heaters within the range wherein the ink ejection characteristics do not deteriorate as compared to a case wherein ink is simultaneously bubbled by the two heaters (e.g., the ink ejection velocity or ejection amount does not decrease), the ink landing precision can be improved by increasing, e.g., the ejection velocity.

In FIG. 12B, the two heaters are simultaneously driven, but the ink portion on the rear heater is bubbled first as in the first case. Likewise, although the front heater is driven first in FIG. 12C, at a given shift period between the drive timings of the two heaters, the ink portions on the two heaters are simultaneously bubbled and that shift period provides a boundary between a case wherein the ink portion on the front heater is bubbled first and a case wherein the ink portion on the rear heater is bubbled first. In terms of the bubbling timings, again, the ink portion on the rear heater is bubbled first in FIGS. 12A and 12B, and the bubbling order of ink portions on the front and rear heaters changes depending on the preheat condition, and the like in FIG. 12C. The ink landing precision can also be improved by increasing, e.g., the ejection velocity by shifting the bubbling timings defined upon driving the two heaters within the range in which the ink ejection characteristics do not deteriorate as compared to a case wherein ink is simultaneously bubbled by the two heaters (e.g., the ink ejection velocity or ejection amount does not decrease).

In either the first or second case, as has been described in the second embodiment, the ink ejection velocity increases by setting the bubbling timing by the rear heater prior to that by the front heater, and conversely, the refill frequency can be greatly improved by setting the bubbling timing by the front heater prior to that by the rear heater.

Furthermore, as shown in FIGS. 11A and 11B and FIGS. 12B and 12C, when the two heaters are driven so that a single pulse is applied within the application time of double pulses, the drive period required per ejection can be prevented from being prolonged even when the heaters are driven by combining the single-pulse and double-pulse schemes and the drive timings or bubbling timings are shifted, as described above. That is, the set drive frequency can be prevented from lowering.

(Another Embodiment)

In the above embodiments, the heaters SH1 and SH2 have equal sizes. However, the present invention can be similarly applied to a case wherein the heaters SH1 and SH2 have different sizes.

Figure 13A:
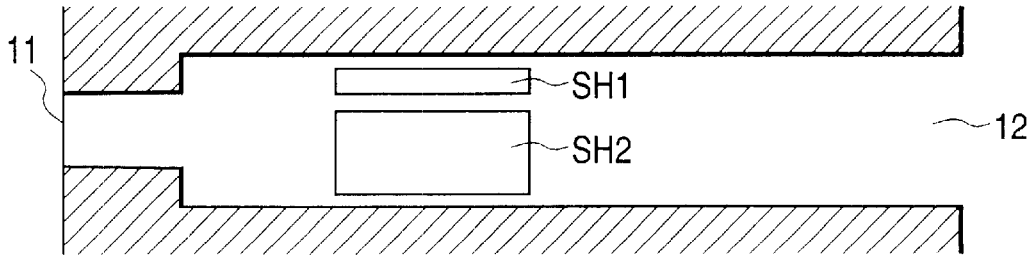
FIGS. 13A, 13B and 13C are sectional views showing various examples of two heaters which are arranged in a single ink channel and have different sizes.
Figure 13B:
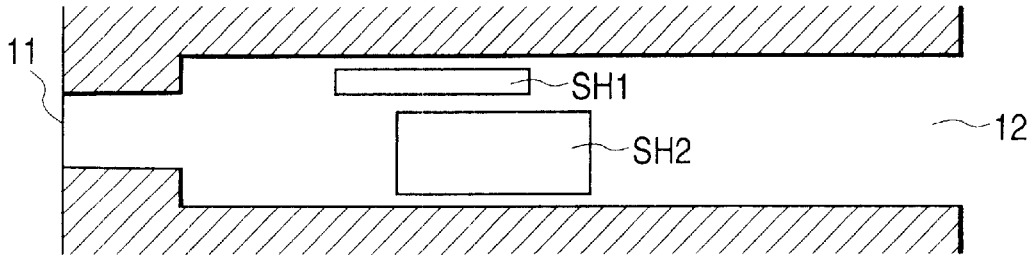
Figure 13C:
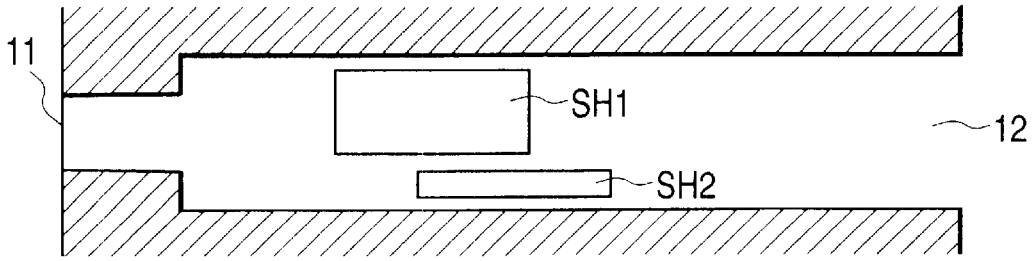

FIGS. 13A to 13C are sectional views showing various examples of heaters arranged in one ink channel and having different sizes. FIG. 13A shows an example wherein two heaters SH1 and SH2 having different sizes are arranged at equal distances from the ejection orifice 11. FIGS. 13B and 13C show examples wherein two heaters SH1 and SH2 having different sizes are arranged at different distances from the ejection orifice 11. In FIG. 13B, the front heater SH1 is larger than the rear heater SH2, and in FIG. 13C, the rear heater SH2 is larger than the front heater SH1.

Figure 14A:
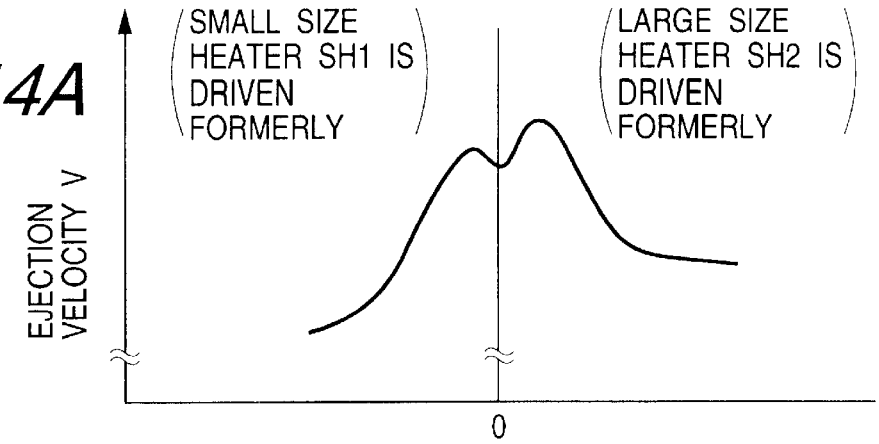
FIGS. 14A, 14B and 14C are graphs showing the relationship of the ejection velocity with respect to the drive timing shift period of the individual heaters in the examples shown in FIGS. 13A, 13B and 13C.
Figure 14B:
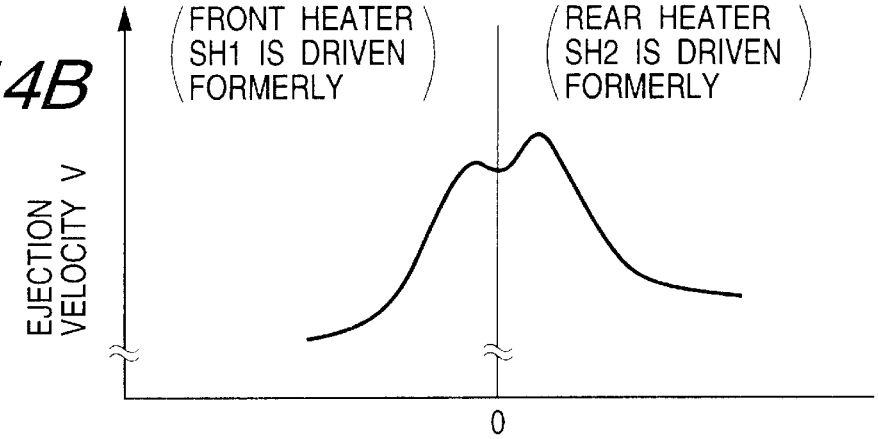
Figure 14C:
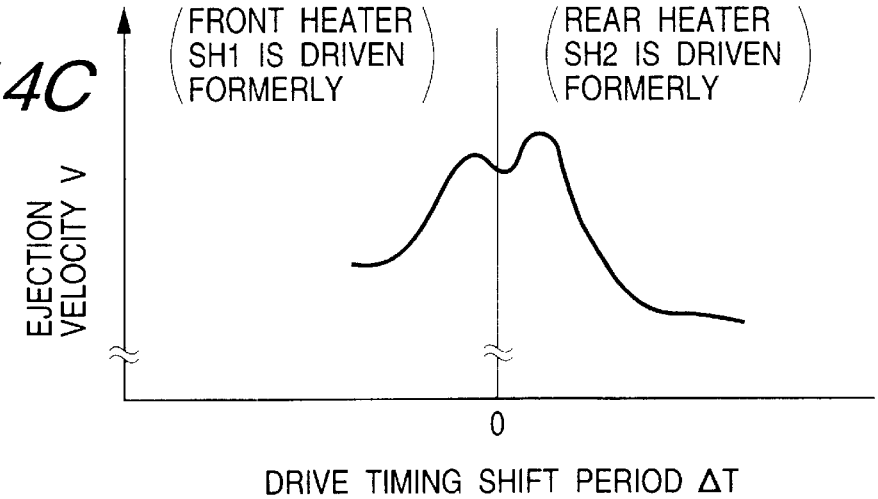

FIGS. 14A to 14C show the relationship of the ejection velocity v with respect to the drive timing shift period $\Delta T$ of the heaters SH1 and SH2. FIGS. 14A to 14C respectively correspond to FIGS. 13A to 13C.

As can be seen from FIGS. 14A to 14C, when the two heaters SH1 and SH2 are arranged at equal distances from the ejection orifice 11, the maximal value of the ejection velocity v obtained when the large size heater SH2 is driven first becomes larger than that obtained when the small size heater SH1 is driven first. On the other hand, when the two heaters SH1 and SH2 are arranged at different distances from the ejection orifice 11, the maximal value of the ejection velocity v obtained when the rear heater SH2 is driven first becomes larger than that obtained when the front heater SH1 is driven first, independently of the sizes of the heaters SH1 and SH2.

Hence, when the heaters SH1 and SH2 have different sizes, the heater to be driven first can be determined based on these results. For example, as the ejection velocity upon driving the small size heater SH1 is low, and the ejection velocity upon driving the large size heater SH2 is high, when a small dot is ejected by driving the small size heater SH1 alone and a large dot is ejected by driving both the small and large size heaters SH1 and SH2, the ejection velocity difference between the small and large dots becomes considerably large. For this reason, in order to prevent the ejection velocity difference from becoming too large, ink is preferably bubbled by the small size heater SH1 first.

The embodiments of the present invention have been described while changing the layout and sizes of the heaters SH1 and SH2. When the heaters SH1 and SH2 are arranged at different distance positions from the ejection orifice 11, they are preferably set at optimal positions on the basis of the following examination results.

Figure 17:
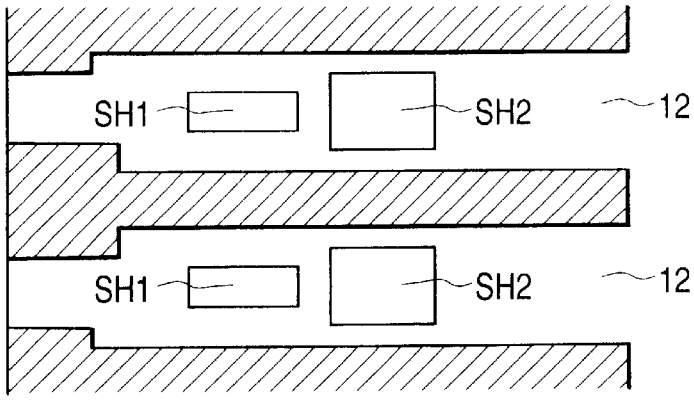
FIG. 17 is a sectional view of an ink channel portion of an ink-jet recording head, in which two heaters having different sizes are arranged in series with each other along an ink channel.

When the difference between the distance from the ejection orifice to the rear heater and the distance from the ejection orifice to the front heater is larger than the length of the front heater, the two heaters SH1 and SH2 may be serially arranged in the longitudinal direction of the ink channel 12, i.e., in the ink ejection direction as shown in FIG. 17. Even when the heaters SH1 and SH2 are serially arranged, the same ejection characteristics as those obtained when they are parallelly arranged can be obtained.

An example of an applicable recording head form will be explained below.

Figure 15:
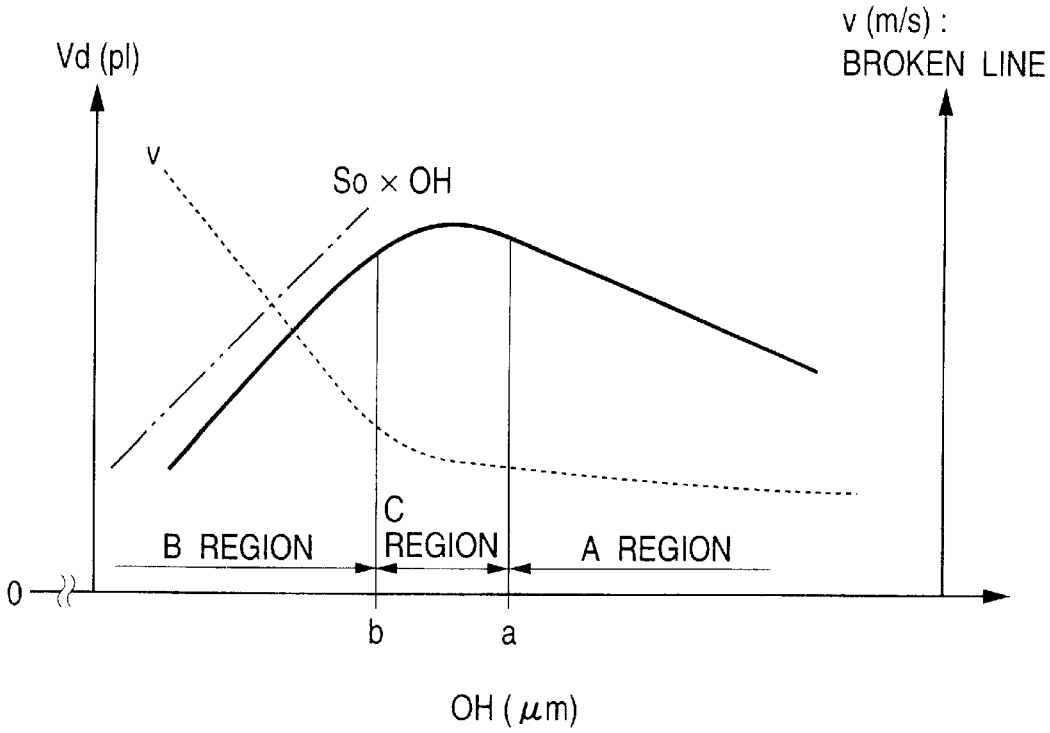
FIG. 15 is a graph showing the relationship of the ink ejection amount Vd and ejection velocity v with respect to the distance OH of heaters from an ejection orifice.
Figure 16:
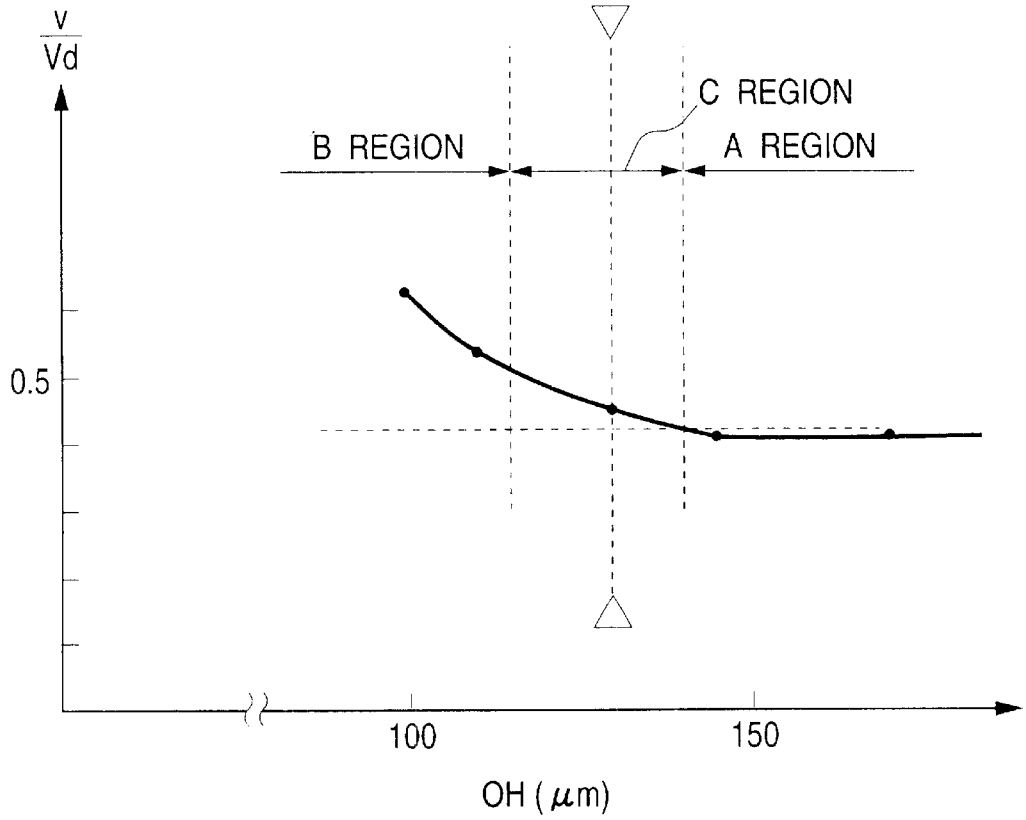
FIG. 16 is a graph showing the relationship of the values obtained by dividing the ejection velocity v by the ejection amount Vd with respect to the distance OH.

FIG. 15 is a graph showing the relationship of the ink ejection amount Vd and ejection velocity v with respect to the distance OH of one heater from the ejection orifice, together with the product of the ejection orifice area So and the distance OH. FIG. 16 is a graph showing the relationship of the value obtained by dividing the ejection velocity v by the ejection amount Vd with respect to the distance OH.

In FIGS. 15 and 16, singular points a and b are defined to divide the distance OH into three regions, i.e., a region A equal to or larger than a, a region B equal to or lower than b, and a region C between a and b. The three regions have tendencies unique to the respective regions: in the region A, the ejection velocity v and the ejection amount Vd are roughly proportional to each other and v/Vd becomes nearly constant as the distance OH increases. In the region B, the ejection amount Vd is roughly proportional to the product of the ejection orifice area So and the distance OH, and in the region C, the ejection amount Vd is nearly constant. Thus, when two heaters having nearly equal sizes are arranged in a single ink channel in consideration of, e.g., ejection amount Vd, the front heater is preferably arranged in the region B, and the rear heater is preferably arranged in the region A, so as to obtain nearly equal ejection amounts Vd.

The above-mentioned regions A to C can also be defined as follows in consideration of each of the ejection amount Vd and ejection velocity v.

<When Considered in Terms of Ejection Amount Vd>

Region A: a section in which the ejection amount Vd decreases as the distance OH increases Region B: a section in which the ejection amount Vd increases in nearly proportional to the distance OH Region C: a section in which the ejection amount Vd becomes roughly constant with respect to the distance OH <When Considered in Terms of Ejection Velocity v>

Over all the sections, the ejection velocity v decreases as the distance OH increases. Especially, in the region C, the rate of change in velocity v is slow.

(Embodiment of Ink-jet Recording Apparatus)

Figure 18:
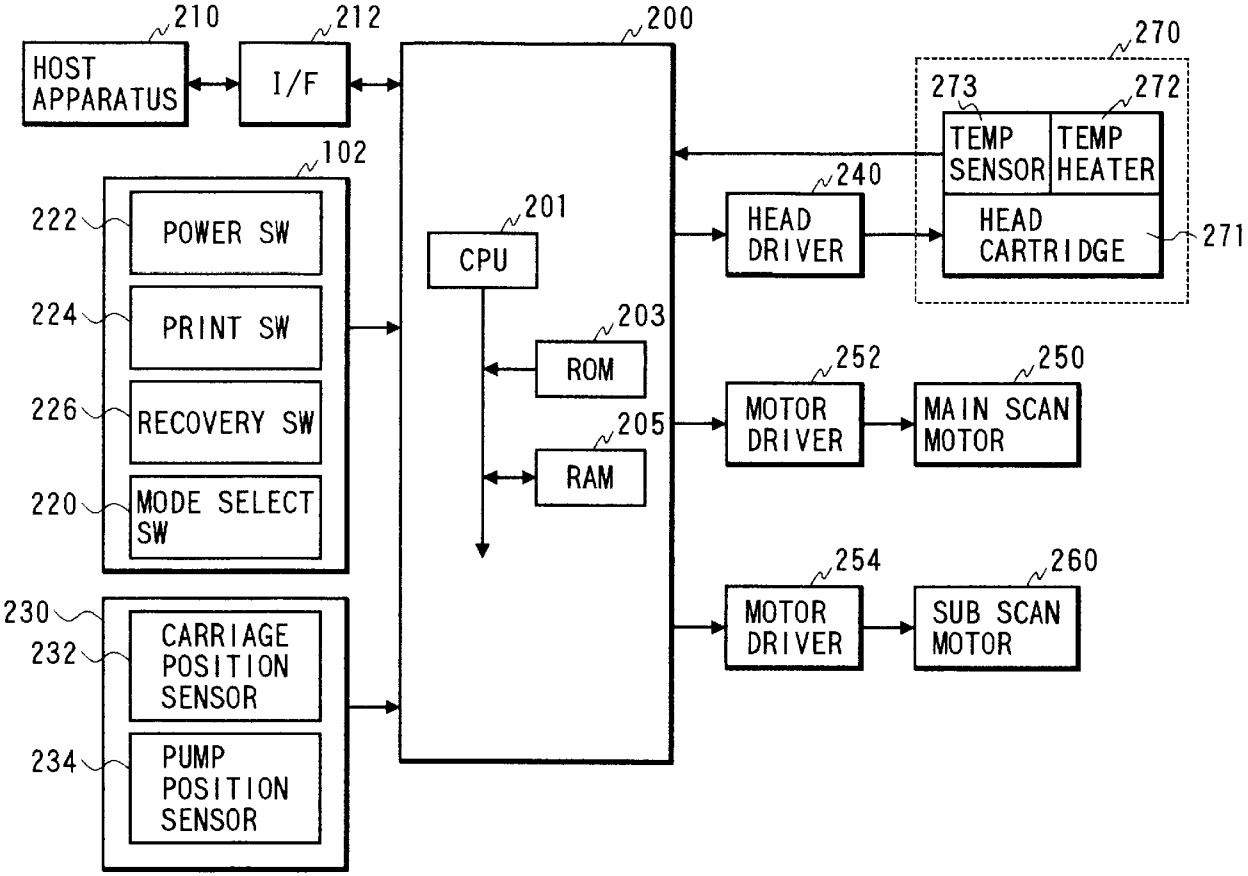
FIG. 18 is a block diagram showing an example of the arrangement of an ink-jet recording apparatus according to the present invention.

FIG. 18 is a block diagram showing an example of the arrangement of an ink-jet recording apparatus according to the present invention.

This ink-jet recording apparatus comprises a carriage 270 which detachably mounts a head cartridge 271 that integrates a recording head and an ink tank, and records on a recording medium by ejecting ink from the recording head while repeating reciprocal scans of the carriage 270 and feeding of the recording medium by a predetermined pitch in a direction perpendicular to the scan direction of the carriage 270. The recording head has two heaters having same size in correspondence with one ink channel. The ink channels of the recording head are arranged at a density of 360 dpi.

In FIG. 18, a controller 200 serving as a main control unit has a CPU 201 in the form of, e.g., a microcomputer for executing various modes (to be described later), a ROM 203 which stores programs and tables corresponding to the procedures to be executed by the CPU, the voltage value and pulse width of heat pulses, and other permanent data, and a RAM 205 allocated with an area for developing image data, a work area, and the like. When the two heaters in a single ink channel are driven, the controller 200 performs control for shifting the drive timings of the heaters of the recording head and determining the heater to be driven first in correspondence with various modes.

A host apparatus 210 serves as a supply source of image data and the like (or may comprise a reader for reading an image), and exchanges image data, other commands, status signals, and the like with the controller 200 via an interface (I/F) 212.

An operation panel 102 has a mode select switch 220 for selecting one of various modes, as will be described later, a power switch 222, a print switch 224 for instructing the start of recording, and a recovery switch 226 for instructing to start ejection recovery processing, and receives commands input by the operator. A sensor group 230 detects the states of the recording apparatus, and includes a carriage position sensor 232 for detecting the position of the carriage 270 such as a home position, start position, and the like, a pump position sensor 234 for detecting the position of a pump including a relief switch, and the like.

A head driver 240 drives the heaters of the recording head in accordance with recording data supplied from the controller 200. Some elements of the head driver 240 are used for driving a temperature heater 272 for performing the temperature control of the recording head. Furthermore, a detection value from a temperature sensor 273 for detecting the temperature of the recording head is input to the controller 200.

A main scan motor 250 reciprocally scans the carriage 270, and is driven by a motor driver 252. A sub-scan motor 260 feeds a recording medium, and is driven by a motor driver 254.

Various ejection modes of this ink-jet recording apparatus will be described below.

<Basic Ejection Amount Mode>

Basically, the apparatus has two ejection amount modes, i.e., small and large ejection amount modes. In the small ejection amount mode, ink is ejected by driving only one heater, and about 20 pl of ink are ejected. In the large ejection amount mode, ink is ejected by driving two heaters, and about 40 pl of ink are ejected.

<Print Mode>

The print mode is normally classified into a normal print mode (360-dpi mode), a high-quality print mode (720-dpi mode), and a multi-value recording mode.

In the normal print mode, 360-dpi printing is done in the large ejection amount mode. The high-quality print mode attains printing at 720×720 dpi by scanning the head twice while shifting the dot position by half the pitch in the small ejection amount mode.

In the multi-value recording mode, the large and small ejection amounts are switched in units of pixels in the high-quality print mode. In this case, when a recording medium free from ink blurring is used, three-value (including no ejection) gradation expression can be effectively achieved for one pixel at 720×720 dpi or 720×360 dpi. When 360-dpi multi-value data is printed in the 360-dpi mode, a high-quality image with high gradation characteristics can be obtained at 360 dpi by printing large and small dot patterns in correspondence with the multi-value data. On the other hand, the original ejection amount may be set to be relatively small, and the temperature of the recording head may be adjusted by the temperature heater 272 to finely adjust the ejection amount range.

<Preliminary Ejection During Printing>

Preliminary ejection during printing is performed in the large ejection amount mode with a high ejection velocity independently of the current ejection amount mode. Especially, in this embodiment, since ejection is attained by shifting the drive timings of the two heaters, the ejection velocity can be further increased. Thus, the time interval for preliminary ejection can be prolonged, and the number of times of preliminary ejection can be reduced.

<Various Examples of Print Methods>

When the heaters to be driven can be changed in units of pixels, i.e., in units of all the heaters in the recording head, a high-quality image can be recorded at high speed.

However, in conjunction with the arrangement of the recording head, the heaters to be driven cannot be switched within a short period of time, and the heaters cannot be switched in units of ink channels. In such case, the ejection amount mode during one scan is either the large or small ejection amount mode. At this time, when multi-value data (three values, i.e., large and small dots per pixel at 720×720 dpi) is printed using large and small dots, printing is done in the large ejection amount mode in the back and forth scan directions, and is done in the small ejection amount mode in the sub-scan direction, thus obtaining an image with high gradation characteristics. When printing is done in this manner, no color nonuniformity is produced even when a plurality of recording heads for ejecting different color inks for color printing are parallelly arranged in the scan direction.

EXAMPLE 1

This example used an ink-jet recording head in which two heaters SH1 and SH2 having the same size were arranged at equal distance positions from an ejection orifice 11 in a single ink channel 12, as shown in FIG. 1. Furthermore, in order to provide compatibility with a conventional single-heater ink-jet recording head, the ink-jet recording head of this example comprises a digital or analog delay circuit as a means for shifting the drive timings of the heaters SH1 and SH2.

The dimensional and positional relationships between the heaters SH1 and SH2, and the ink channel 12 are as described in the first embodiment. More specifically, the area of each of the heaters SH1 and SH2 is 17 $\mu$m×130

$\mu$m=2,210 $\mu m^2$, and the total area of the two heaters SH1 and SH2 in one ink channel 12 is 4,420 $\mu m^2$. With this area, input energy upon driving the two heaters SH1 and SH2 equals that upon driving the conventional ink-jet head. The delay circuit is set to drive the two heaters SH1 and SH2 while shifting their drive timings by 0.15 $\mu$s upon reception of a drive signal.

When printing was done by mounting the ink-jet recording head of this example on a single-heater recording apparatus, both the ejection velocity and ejection amount could be maintained nearly the same as those of a single-heater ink-jet recording head while input energy remained the same as that for the single-heater ink-jet recording head. If the two heaters SH1 and SH2 are simultaneously driven to perform printing at a maximum print duty, the landing precision may be impaired owing to low ejection velocity and ejection amount, and the print quality may be impaired or printed images may be blurred.

Like in this example, by shifting the drive timings of the two heaters SH1 and SH2, a good print result free from blurring could be obtained. Since a means for shifting the drive timings of the heaters SH1 and SH2 was arranged in the ink-jet recording head, the head could be used without posing any problems even when it was mounted on many single-heater recording apparatuses already on the market. Of course, when the ink-jet recording head of this example is mounted on a single-heater recording apparatus, the two heaters SH1 and SH2 cannot be individually driven, but when it is mounted on a recording apparatus using a multi-heater ink-jet recording head, the two heaters SH1 and SH2 can be driven independently to vary the ejection amount, thus accomplishing gradation recording.

EXAMPLE 2

This example also used an ink-jet recording head in which two heaters SH1 and SH2 having the same size were arranged at equal distance positions from an ejection orifice 11 in a single ink channel 12, as shown in FIG. 1. Although the dimensional and positional relationships of the heaters SH1 and SH2, and the like are the same as those in Example 1, a means for shifting the drive timings of the two heaters SH1 and SH2 is arranged not in the ink-jet recording head but in the recording apparatus, and when the two heaters SH1 and SH2 are driven, the timings of drive pulses are shifted by the recording apparatus side. In this manner, the ejection velocity and ejection amount could be improved as compared to those upon simultaneously driving the heaters SH1 and SH2. Also, the heaters SH1 and SH2 can be individually driven to attain gradation recording.

EXAMPLE 3

This example used an ink-jet recording head in which two heaters SH1 and SH2 having the same size were arranged at different distance positions from an ejection orifice 11 in a single ink channel 12, as shown in FIG. 6. The sizes of the heaters SH1 and SH2 were the same as those of Example 1, and the positional relationship between the heaters SH1 and SH2 was set so that the distance OH between the front heater SH1 and the ejection orifice 11 was 110 $\mu$m, and the distance OH' between the rear heater SH2 and the ejection orifice 11 was 165 $\mu$m. A means for shifting the drive timings of the heaters SH1 and SH2 was arranged in the recording apparatus, and when the two heaters SH1 and SH2 were driven, the rear heater SH2 was driven 0.2 $\mu$s after the front heater SH1 was driven.

Table 2 below shows the measurement results of the ejection velocity v, ejection amount Vd, and refill frequency fr in this case. For the sake of comparison, table 2 below also shows the ejection velocity v, ejection amount Vd, and refill frequency fr obtained upon simultaneously driving the two heaters SH1 and SH2.

TABLE 2

| | v (m/s) | Vd (pl) | fr (kHz) |
|---|---|---|---|
| Example 3 | 12.5 | 39.5 | 10.1 |
| Simultaneous Driving | 12 | 38 | 8.8 |

As can be seen from Table 2 above, in Example 3, all of the ejection velocity v, ejection amount Vd, and refill frequencies are improved as compared to those obtained upon simultaneously driving the two heaters. Especially, the ejection amount Vd and refill frequency fr are greatly improved. Hence, this example is suitable for recording on a medium or recording mode that requires high-density recording, and high-speed recording.

EXAMPLE 4

This example also used an ink-jet recording head in which two heaters SH1 and SH2 having the same size were arranged at different distance positions from an ejection orifice 11 in a single ink channel 12, as shown in FIG. 6. The dimensional and positional relationships of the heaters SH1 and SH2, and the like are the same as those in Example 3. Also, a means for shifting the drive timings of the heaters SH1 and SH2 is arranged in the recording apparatus as in Example 3, and the drive order upon driving the two heaters SH1 and SH2 is the same as that in Example 3. This example is different from Example 3 in that the drive timing shift period upon driving the two heaters SH1 and SH2 is set at 0.3 $\mu$s.

When the ejection characteristics in this case were measured, the ejection velocity v was 12 m/s, and the ejection amount Vd was 38 pl, and they were equivalent to those obtained upon simultaneously driving the two heaters SH1 and SH2. On the other hand, the refill frequency fr was greatly improved to 10.3 kHz. Hence, this example is also suitable for high-speed recording.

Paying attention to the result that the ejection velocity v and ejection amount Vd are equivalent to those obtained upon simultaneously driving the two heaters SH1 and SH2, this example can selectively use a high-speed recording mode in which the refill frequency fr is improved by shifting the drive timings of the two heaters SH1 and SH2, and a low-speed recording mode in which the two heaters SH1 and SH2 are simultaneously driven, as needed. For example, in order to record a higher-resolution image, a so-called multi-pass recording method for performing a plurality of times of scans on an identical line while shifting the dot positions is known. In normal recording, the low-speed mode may be selected, and in multi-pass recording, the high-speed mode may be selected to perform recording.

Since the ejection velocity v and ejection amount Vd are equivalent to those obtained by simultaneous driving, even when the ink-jet recording head used in this example is mounted on a conventional single-heater recording apparatus and the two heaters SH1 and SH2 are simultaneously driven, substantially the same ejection characteristics as those of the recording apparatus of this example can be obtained, except that the refill frequency fr decreases.

EXAMPLE 5

This example also used an ink-jet recording head in which two heaters SH1 and SH2 having the same size were arranged at different distance positions from an ejection orifice 11 in a single ink channel 12, as shown in FIG. 6, as in Example 3, and the timing shift control upon driving the two heaters was performed on the recording apparatus side. This example is different from Example 3 in that when the two heaters are driven, the front heater SH1 is driven 0.2 $\mu$s after the rear heater SH2 is driven.

When the ejection characteristics at that time were measured, the ejection velocity v was 13.5 m/s, the ejection amount Vd was 38.5 pl, and the refill frequency fr was 8.4 kHz. That is, the ejection velocity v was greatly improved, but the refill frequency fr decreased slightly.

Since the ejection velocity v is greatly improved, the ink landing precision is improved, and high-quality recording can be realized. In a low-temperature environment, the ink viscosity increases, and the ejection velocity v tends to decrease. However, in this example, even in a low-temperature environment, a sufficiently high ejection velocity v can be obtained.

In an ink-jet recording apparatus, in general, ink with high viscosity due to evaporation of water components of the ink at the ejection orifice becomes attached to the vicinity of the ejection orifice, and may cause ejection errors. In order to prevent this, ejection called preliminary ejection is performed at predetermined time intervals in addition to recording to remove high-viscosity ink. However, if the ejection velocity is low, such high-viscosity ink cannot often be removed completely.

However, in this example, since the ejection velocity v is greatly improved, even high-viscosity ink can be removed by preliminary ejection. Hence, the time interval of preliminary ejection can be prolonged, and the number of times of preliminary ejection during recording can be reduced. That is, although the recording speed lowers due to a decrease in refill frequency fr, the throughput substantially does not lower in view of the total time from the beginning to the end of recording. Since the number of times of preliminary ejection is reduced, ink can be effectively used.

EXAMPLE 6

This example also used an ink-jet recording head in which two heaters SH1 and SH2 were arranged, as shown in FIG. 6, as in Example 3, but the ink-jet recording head itself comprised a means for shifting the drive timings of the two heaters SH1 and SH2. That is, the recording head of this example can also be used in a single-heater recording apparatus. The drive order of the heaters SH1 and SH2 and the drive timing shift period upon driving the two heaters SH1 and SH2 were the same as those in Example 3.

In this example, if the heaters SH1 and SH2 have the same sizes as those in Example 3, the same ejection characteristics as in Example 3 can be obtained, and the ejection velocity v and ejection amount Vd are improved. However, since this example has as its objective to use the head also in a single-heater recording apparatus, the ejection velocity v and the ejection amount Vd must be matched with those of that recording apparatus. Hence, the areas of the heaters SH1 and SH2 were respectively reduced by 5%.

When the refill frequency fr of the ink-jet recording head of this example was measured, it was 11 kHz, and was greatly improved. Hence, when the ink-jet recording head of this example is used, the recording speed of the main body can also be greatly improved.

As described above, according to the present invention, the ink ejection velocity or ejection amount can be increased without changing energy to be applied to heaters, and the landing precision can be improved. On the other hand, when the layout and drive order of electro-thermal conversion elements are set in an appropriate range, the refill frequency of ink can be greatly improved, and high-speed recording can also be achieved.

In particular, in the ink-jet recording head and ink-jet recording apparatus of the present invention, when the relative bubbling timings are shifted to have the same ink ejection velocity as that obtained by simultaneous bubbling, compatibility with a single-heater ink-jet head having one electro-thermal conversion element in correspondence with one ink channel or a single-heater ink-jet recording apparatus can be provided.

What is claimed is:

1. In a method of operating an ink-jet recording head which has at least two electro-thermal heating elements arranged in an ink flow passage which has a single ejection orifice, the step of:

energizing said heating elements at different times to eject ink from said orifice, said different times being separated from each other by an mount $\Delta T$ which causes at least one of the following characteristics of the ink ejection to be not less than in the case where the heating elements are energized simultaneously:

(a) the ejection velocity of ink from the orifice;

(b) the amount of ink ejected from the orifice per ejection; and (c) the refill frequency of ink into said passage, wherein an absolute value of said amount $\Delta T$ is within a range in which:

$$0<|\Delta T|<0.5\ \mu s.$$

2. A method according to claim 1, wherein the absolute $\Delta T$ falls within a range $0<|\Delta T|<0.3\ \mu s$.

3. In a method of operating an ink-jet recording head which has at least two electro-thermal heating elements arranged in an ink flow passage which has a single ejection orifice, the step of:

energizing said heating elements at different times to eject ink from said orifice, said different times being separated from each other by an amount which causes at least one of the following characteristics of the ink ejection to be not less than in the case where the heating elements are energized simultaneously:

(a) the ejection velocity of ink from the orifice;

(b) the amount of ink ejected from the orifice per ejection; and (c) the refill frequency of ink into said passage, wherein a preheat pulse that does not bubble the ink and a main heat pulse that bubbles the ink after the preheat pulse, are applied to each of the at least two electro-thermal heating elements driven for bubbling the ink.

4. In a method of operating an ink-jet recording head which has at least two electro-thermal heating elements arranged in an ink flow passage which has a single ejection orifice, the step of:

energizing said heating elements at different times to eject ink from said orifice, said different times being separated from each other by an amount which causes at least one of the following characteristics of the ink ejection to be not less than in the case where the heating elements are energized simultaneously:

(a) the ejection velocity of ink from the orifice;

(b) the amount of ink ejected from the orifice per ejection; and (c) the refill frequency of ink into said passage, wherein a single pulse is applied to at least one of the at least two electro-thermal heating elements driven for bubbling the ink, and a preheat pulse that does not bubble the ink and a main heat pulse that bubbles the ink after the preheat pulse, are applied to the other electro-thermal heating element.

5. A method according to claim 4, wherein a total of pulse widths of the preheat pulse and main heat pulse is substantially equal to a pulse width of the single pulse.

6. A method according to claim 4, wherein the single pulse is applied during an interval from the beginning of application of the preheat pulse to the end of application of the main heat pulse.

7. A method according to claim 4, wherein when said at least two of the electro-thermal heating elements to be driven are arranged at different distance positions from the ejection orifice, the single pulse is applied to the electro-thermal heating element located at a position nearer the ejection orifice, and the preheat pulse and main heat pulse are applied to the electro-thermal heating element located at a position farther from the ejection orifice.

8. In an ink-jet recording head which has at least two electro-thermal heating elements arranged in an ink flow passage which has a single ejection orifice:

means for energizing said heating elements at different times to eject ink from said orifice, said different times being separated from each other by an amount which causes at least one of the following characteristics of the ink ejection to be not less than in the case where the heating elements are energized simultaneously:

(a) the ejection velocity of ink from the orifice;

(b) the amount of ink ejected from the orifice per ejection; and (c) the refill frequency of ink into said passage.

9. A head according to claim 8, wherein said means for energizing said heating elements at different times shifts the relative energizing timings so as to obtain the same ejection velocity as an ejection velocity obtained when the ink is bubbled by simultaneously driving the electro-thermal heating elements to be driven.

10. A head according to claim 8, wherein said means for energizing said heating elements at different times shifts the relative energizing timings so as to obtain the same ejection amount as an ejection amount obtained when the ink is bubbled by simultaneously driving the electro-thermal heating elements to be driven.

11. A head according to claim 8, wherein said means for energizing said heating elements at different times comprises a delay circuit.

12. A head according to claim 8, wherein when the electro-thermal heating elements to be driven are arranged at equal distance positions from the ejection orifice and have different surface areas, said energizing means drives the electro-thermal heating element with a larger surface area first to bubble the ink.

13. In an ink-jet recording head which has at least two electro-thermal heating elements arranged in an ink flow passage which has a single ejection orifice:

means for energizing said heating elements at different times to eject ink from said orifice, said different times being separated from each other by an amount $\Delta T$ which causes at least one of the following characteristics of the ink ejection to be not less than in the case where the heating elements are energized simultaneously:

(a) the ejection velocity of ink from the orifice;

(b) the amount of ink ejected from the orifice per ejection; and (c) the refill frequency of ink into said passage, wherein an absolute value of said amount $\Delta T$ is within a range in which:

$$0<|\Delta T|<0.5\ \mu s.$$

14. A head according to claim 13, wherein the absolute value of said amount $\Delta T$ falls within a range $0<|\Delta T|<0.3\ \mu s$.

15. In an ink-jet recording apparatus for recording using an ink-jet recording head which has a plurality of independently driven electro-thermal conversion elements that are arranged in an ink channel which communicates with an ejection orifice, and ejects ink by driving the electro-thermal conversion elements:

a carriage which carries said ink-jet recording head; and means for relatively shifting bubble timings defined upon driving at least two of said electro-thermal conversion elements such that said conversion elements are energized at different times to eject ink from said orifice, said different times being separated from each other by an amount which causes at least one of the following characteristics of the ink ejection to be not less than in the case where the conversion elements are energized simultaneously:

(a) the ejection velocity of ink from the orifice;

(b) the amount of ink ejected from the orifice per ejection; and (c) the refill frequency of ink into said passage.

16. An apparatus according to claim 15, wherein said shifting means relatively shifts the bubbling timings so as to obtain the same ejection velocity as an ejection velocity obtained when the ink is bubbled by simultaneously driving the electro-thermal conversion elements to be driven.

17. An apparatus according to claim 15, wherein said shifting means relatively shifts the bubbling timings so as to obtain the same ejection amount obtained when the ink is bubbled by simultaneously driving the electro-thermal conversion elements to be driven.

18. An apparatus according to claim 15, wherein when the electro-thermal conversion elements to be driven are arranged at equal distance positions from the ejection orifice and have different surface areas, said shifting means drives the electro-thermal conversion element with a larger surface area first to bubble the ink.

19. An apparatus according to claim 15, wherein when said at least two of the electro-thermal conversion elements to be driven are arranged at different distance positions from the ejection orifice, said shifting means drives the electro-thermal conversion element located at a position nearer the ejection orifice first to bubble the ink.

20. An apparatus according to claim 15, wherein when said at least two of the electro-thermal conversion elements to be driven are arranged at different distance positions from the ejection orifice, said shifting means drives the electro-thermal conversion element located at a position farther from the ejection orifice first to bubble the ink.

21. In an ink-jet recording apparatus for recording using an ink-jet recording head which has a plurality of independently driven electro-thermal conversion elements that are arranged in an ink channel which communicate with an ejection orifice and can be independently driven, and ejects ink by driving the electro-thermal conversion elements:

a carriage which carries said ink-jet recording head; and means for relatively shifting bubble timings defined upon driving at least two of said electro-thermal conversion elements such that said conversion elements are energized at different times to eject ink from said orifice, said different times being separated from each other by an amount which causes at least one of the following characteristics of the ink ejection to be not less than in the case where the conversion elements are energized simultaneously:

(a) the ejection velocity of ink from the orifice;

(b) the amount of ink ejected from the orifice per ejection; and (c) the refill frequency of ink into said passage, said means for relatively shifting bubble timings being constructed to shift the bubbling timings by an amount ΔT within a range in which:

$$0<|\Delta T|<0.5\ \mu s.$$

22. An apparatus according to claim 21, wherein the bubbling timing shift period ΔT falls within a range $0<|\Delta T|<0.3\ \mu s$.

23. In a method of operating an ink-jet recording head which has at least two electro-thermal heating elements arranged in an ink flow passage which has a single ejection orifice, the step of:

energizing said heating elements at different times to eject ink from said orifice in a manner such that at least one of the following characteristics of the ink ejection is not less than in the case where the heating elements are energized simultaneously:

(a) the ejection velocity of ink from the orifice;

(b) the amount of ink ejected from the orifice per ejection; and (c) the refill frequency of ink into said passage, wherein when the electro-thermal heating element located at a position further from the ejection orifice bubbles the ink first, the ink is ejected from the ejection orifice by relatively shifting the bubbling timings within a range:

$$0<|\Delta T|<4\times10^{-3}\ (\mathrm{s/m})\times\Delta OH(\mu\mathrm{m})\times2$$

where ΔT is the relative bubbling timing shift period upon driving the individual electro-thermal heating elements, and ΔOH is a shift amount between the electro-thermal heating elements.

24. A method according to claim 23, wherein a single pulse is applied to each of the at least two electro-thermal heating elements driven for bubbling the ink.

25. In a method of operating an ink-jet recording head which has at least two electro-thermal heating elements arranged in an ink flow passage which has a single ejection orifice, the step of:

energizing said heating elements at different times to eject ink from said orifice in a manner such that at least one of the following characterstics of the ink ejection is not less than in the case where the heating elements are energized simultaneously:

(a) the ejection velocity of ink from the orifice;

(b) the amount of ink ejected from the orifice per ejection; and (c) the refill frequency of ink into said passage, wherein said electro-thermal heating elements are different in surface area from each other.

26. A method according to claim 25 wherein the heating element having a small surface area is located at a position nearer to the ejection orifice to bubble the ink first.

27. In a method of operating an ink-jet recording head which has at least two electro-thermal heating elements arranged in an ink flow passage which has a single ejection nozzle, the step of:

energizing said heating elements at different times to eject ink from said nozzle in a manner such that at least one of the following characteristics of the ink ejection is not less than in the case where the heating elements are energized simultaneously:

(a) the ejection velocity of ink from the nozzle; and (b) the amount of ink ejected from the nozzle per ejection, wherein when said at least two of the electro-thermal heating elements to be driven are arranged at different distance positions from the ejection nozzle, the ink is bubbled first by the electro-thermal heating element located at a position nearer the ejection nozzle.

28. In an ink-jet recording head which has at least two electro-thermal heating elements arranged in an ink flow passage which has a single ejection orifice:

means for energizing said heating elements at different times to eject ink from said orifice in a manner such that at least one of the following characteristics of the ink ejection is not less than in the case where the heating elements are energized simultaneously:

(a) the ejection velocity of ink from the orifice;

(b) the amount of ink ejected from the orifice per ejection; and (c) the refill frequency of ink into said passage, said two electro-thermal heating elements being arranged at different distance positions from the ejection orifice and said energizing means being arranged to drive the electro-thermal heating element located at a position nearer the ejection orifice first to bubble the ink.

* * * * *

UNITED STATES PATENT AND TRADEMARK OFFICE

CERTIFICATE OF CORRECTION

PATENT NO. : 6,382,768 B1 
DATED : May 7, 2002
INVENTOR(S) : Noribumi Koitabashi et al.

It is certified that error appears in the above-identified patent and that said Letters Patent is hereby corrected as shown below:

Title page,
Item [56], References Cited, under FOREIGN PATENT DOCUMENTS,
"62240558 should read -- 62-240558
62261452 should read 62-261452
06216957" should read 6-216957 --.
"55132259" should read -- 55-132259 --.

Column 3,
Line 6, "AT" should read -- ΔT --.

Column 11,
Line 2, "AOH" should read -- ΔOH --.

Column 14,
Line 64, "in" should be deleted.

Column 20,
Line 21, "mount" should read -- amount --; and
Line 28, "Passage, wherein" should read -- passage, π wherein --.

Signed and Sealed this

Twenty-third Day of July, 2002

*Attest:*

*Attesting Officer*

JAMES E. ROGAN
*Director of the United States Patent and Trademark Office*